US005403253A

United States Patent [19]

Gaylord

[11] Patent Number: 5,403,253

[45] Date of Patent: Apr. 4, 1995

[54] EXERCISE AND GYMNASTICS TRAINING MACHINE

[76] Inventor: Mitchell J. Gaylord, 27725 Pinestrap Cir., Laguna Hills, Calif. 92653

[21] Appl. No.: 12,192

[22] Filed: Feb. 2, 1993

[51] Int. Cl.[6] ..... A63B 7/00

[52] U.S. Cl. ..... 482/43; 482/69; 482/23; 482/140; 482/143; 482/142

[58] Field of Search ..... 482/143, 38, 43, 23, 482/24, 41, 142, 140, 141, 69

[56] References Cited

U.S. PATENT DOCUMENTS

| | | | |
|---|---|---|---|
| 345,856 | 7/1886 | O'Brien . | |
| 676,771 | 6/1901 | Reach . | |
| 804,218 | 11/1905 | Fiedler . | |
| 1,034,714 | 8/1912 | Kindleberger . | |
| 1,374,697 | 4/1921 | Werndli . | |
| 2,262,761 | 11/1941 | Gay | 482/23 |
| 2,760,774 | 8/1956 | Perez . | |
| 3,476,385 | 11/1969 | Foy . | |
| 3,937,461 | 2/1976 | Lew . | |
| 4,052,070 | 10/1977 | Lew . | |
| 4,125,257 | 11/1978 | Lew | 482/43 |
| 4,431,184 | 2/1984 | Lew et al. | 482/43 |

FOREIGN PATENT DOCUMENTS

| | | | |
|---|---|---|---|
| 829380 | 6/1938 | France . | |
| 926434 | 10/1947 | France . | |
| 1180387 | 6/1959 | France | 482/69 |
| 1018341 | 10/1957 | Germany . | |
| 376408 | 8/1932 | United Kingdom . | |
| 222225 | 7/1968 | U.S.S.R. . | |

*Primary Examiner*—Stephen R. Crow
*Assistant Examiner*—Lynne A. Reichard
*Attorney, Agent, or Firm*—Morrill, MacPherson, Franklin & Friel Skjerven

[57] ABSTRACT

A freestanding exercise and gymnastics training machine allows improved control and balance when doing ring exercises. The exercise and gymnastics training machine comprises a first block and tackle pulley system and a second block and tack system which together suspend a body harness from a freestanding support frame. Accordingly, a user of average strength wearing the body harness can utilize a mechanical advantage afforded by the block and tackle systems to lift and/or support his/her body weight to remain at least partially suspended from the freestanding support frame. While suspended or partially suspended, the user can perform various exercises to improve conditioning, to increase strength and/or to do gymnastics training. In some embodiments, the exercise machine further comprises a footrest attachment, a bench attachment, a pull-up bar attachment, and/or a parallel bar attachment. Preferably, the support frame has an assembled maximum height of less than eight feet so that the exercise machine can be used in the home in a room of standard eight foot ceiling height. In some embodiments, the exercise machine comprises a wall attachment support rather than a freestanding support so that the exercise machine can be mounted on a wall such as a garage wall or the wall of a gymnasium.

24 Claims, 27 Drawing Sheets

FIG. 3A
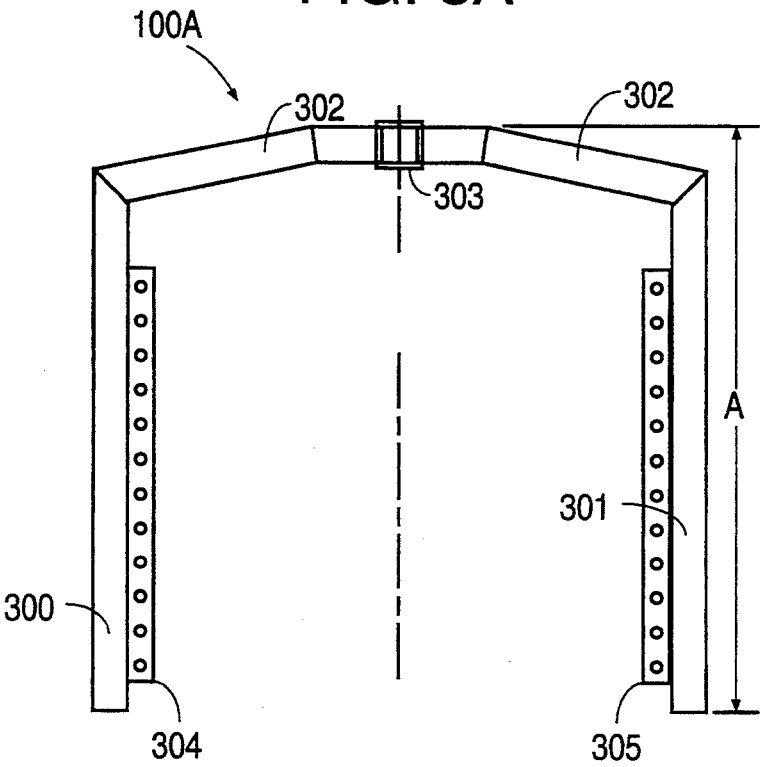
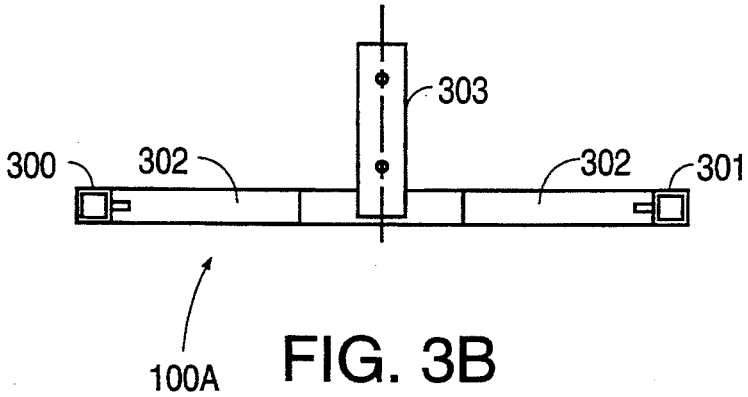
FIG. 3B
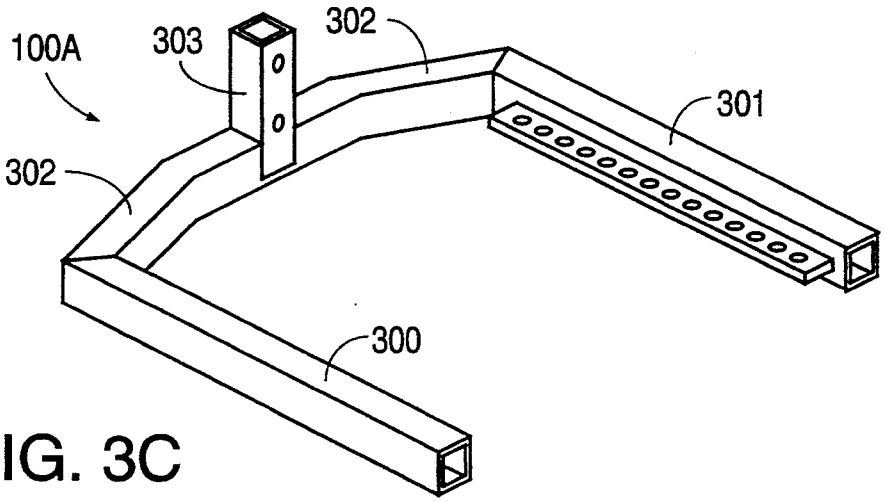
FIG. 3C

FIG. 5A
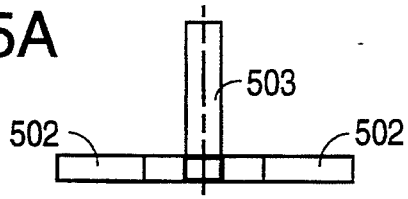
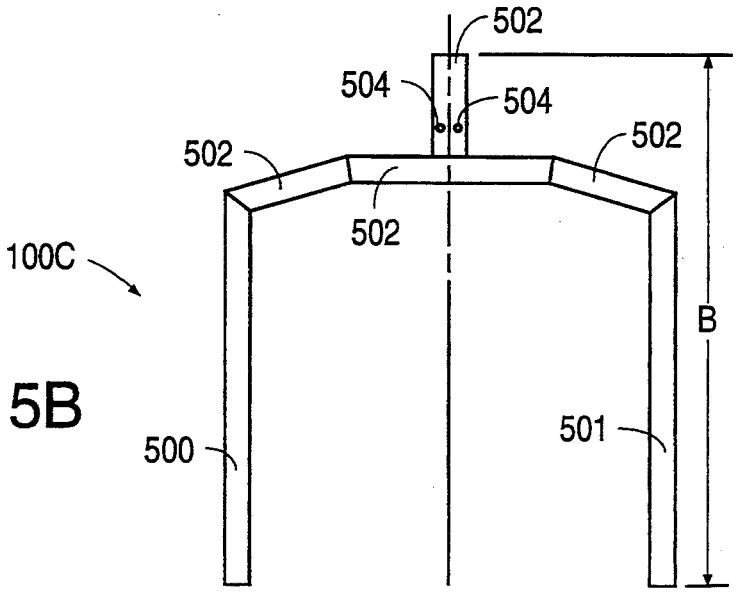
FIG. 5B
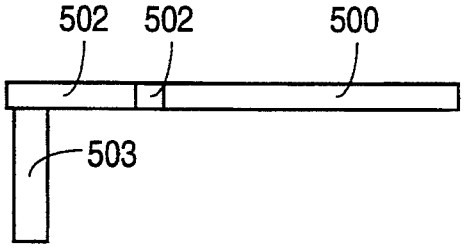
FIG. 5C
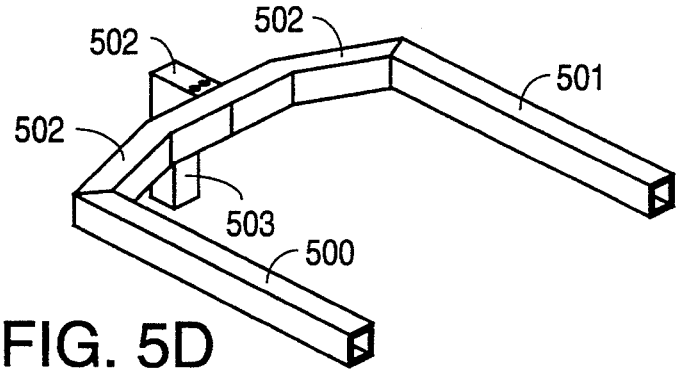
FIG. 5D

EXERCISE AND GYMNASTICS TRAINING MACHINE

FIELD OF THE INVENTION

This invention relates to exercising the human body. More particularly, this invention relates to an exercise machine for exercising the human body which finds special use in conditioning, body building, and in gymnastics training.

BACKGROUND INFORMATION

Gymnastics rings are one of the most common gymnastics apparatuses in men's gymnastics. A classic gymnastics exercise performable on the rings which requires a great deal of physical strength to perform is known as the "iron cross". Gymnasts in the past have developed the strength, balance and skill necessary to perform the iron cross by rigging pulley systems to real gymnastics ring setups. Other times, gymnasts have rigged pulley systems to another piece of gymnastics apparatus known as the high bar.

FIG. 1 (Prior Art) shows a gymnast 1 practicing the iron cross exercise using such a pulley system rigged to a real gymnastics ring setup. The real gymnastics rings 2 are shown hanging by lines 3 which normally suspend the rings 2 from the ceiling 4 of a gymnasium. Such lines 3 are usually quite long and may have a length of about 20 feet. The pulley assembly which is rigged to the real gymnastics ring setup comprises pulleys 5–8, ropes 9 and 10, rings 11 and 12, and a harness 13. By using the pulley system to support the weight of the gymnast, the gymnast 1 could utilize a mechanical advantage realized by a block and tackle pulley system of the pulley system to power up into and pull out from the iron cross position multiple times until the gymnast 1 had developed the necessary strength, balance and skill to the do the iron cross exercise on the real rings 2 without the aid of pulleys.

Although practicing the iron cross on such a pulley system was possible for an already somewhat accomplished gymnast, a significant amount of control, balance, and strength was required in order to control the setup. The ropes 9 and 10 of the pulley system typically were stretchable under the body weight of the gymnast 1. If more weight was placed on one ring of the pulley system than was placed on the other, one of the ropes 9 or 10 could stretch to be longer than the other rope. The gymnast could therefore find himself trying to learn to hold the iron cross position from uneven rings 11 and 12. In FIG. 1, the rings of the pulley system are shown in such an awkward uneven position with ring 11 being lower than ring 12.

Moreover, the relatively long lines 3 which normally attached the rings 2 of the real gymnastics ring setup to the gymnasium ceiling 4 often began to vibrate under the trembling of the struggling gymnast 1. This vibration often contributed to a loss of balance and control. Accordingly, maintaining balance with uneven and vibrating rings made practicing the iron cross with the pulley system quite difficult in itself. Additional people called "spotters" were therefore often required to prevent the gymnast from swinging and to prevent injury to the gymnast in the event that the gymnast were to lose balance and fall from the pulley system when attempting to learn the iron cross exercise.

Today, in physical exercising and conditioning, there is a general trend away from building large bulky muscles and toward building lean yet strong muscles. High repetition aerobic and semi-aerobic conditioning exercising has therefore become popular in comparison to relatively low repetition power lifting of heavy weights. New exercise machines for the gymnasium, the health club, and the home alike are therefore sought which build lean, attractive strong muscle through relatively high repetition exercising without the need of spotters.

SUMMARY OF THE INVENTION

A freestanding exercise and gymnastics training machine allows improved control and balance when doing ring exercises. The exercise and gymnastics training machine comprises a first block and tackle pulley system and a second block and tackle pulley system which together suspend a body harness from a freestanding support frame. Accordingly, a user of average upper body strength can utilize a mechanical advantage afforded by the block and tackle systems to lift and support his/her body weight to remain at least partially suspended from the freestanding support frame. While suspended or partially suspended, the user can perform various exercises to improve conditioning and/or to do gymnastics training.

In some embodiments, each of the first and second block and tackle pulley systems comprises a first pulley or group of pulleys connected to the support frame, a second pulley or group of pulleys connected to the harness, a handle such as a gymnastics ring, and a line. One end of the line of each block and tackle pulley system is connected to the handle or gymnastics ring of the block and tackle pulley system. The other end of the line of each block and tackle pulley system is fixed with respect to either the support frame or the harness. The line of each block and tackle system is then is operatively wrapped around the first and second pulleys of the block and tackle pulley system so that a user's exertion of a force on the ring in a direction away from the first pulley results in a mechanical advantage being realized to lift the user in the harness upward. The first block and tackle pulley system is provided for one hand of the user whereas the second block and tackle pulley system is provided for the other hand of user. The first and second block and tackle systems can provide any even mechanical advantage including a 2 to 1, a 4 to 1, or an 8 to 1 mechanical advantage. The line operatively wrapped around the pulleys is sufficiently resistant to stretching so that the handles do not become significantly uneven under the weight of the user.

In some embodiments, the exercise machine further comprises a footrest attachment, a bench attachment, a pull-up bar attachment, and/or a parallel bar attachment. In some embodiments, the exercise machine comprises part of another exercise machine. The present invention finds special use in the home, in health clubs, in schools, in gymnasiums, in conditioning, in physical rehabilitation, in rehabilitating the physically handicapped, in building muscle, and in gymnastics training. In some embodiments, the exercise machine is not freestanding. Rather, the first and second block and tackle pulley systems and the body harness are suspended from a wall attachment.

BRIEF DESCRIPTION OF THE DRAWINGS

FIGS. 3A, 3B and 3C are views illustrating a base portion of the embodiment of FIG. 2.

FIGS. 5A, 5B, 5C and 5D are views illustrating an upper portion of the embodiment of FIG. 2.

DETAILED DESCRIPTION OF THE PREFERRED EMBODIMENTS

Figure 1:
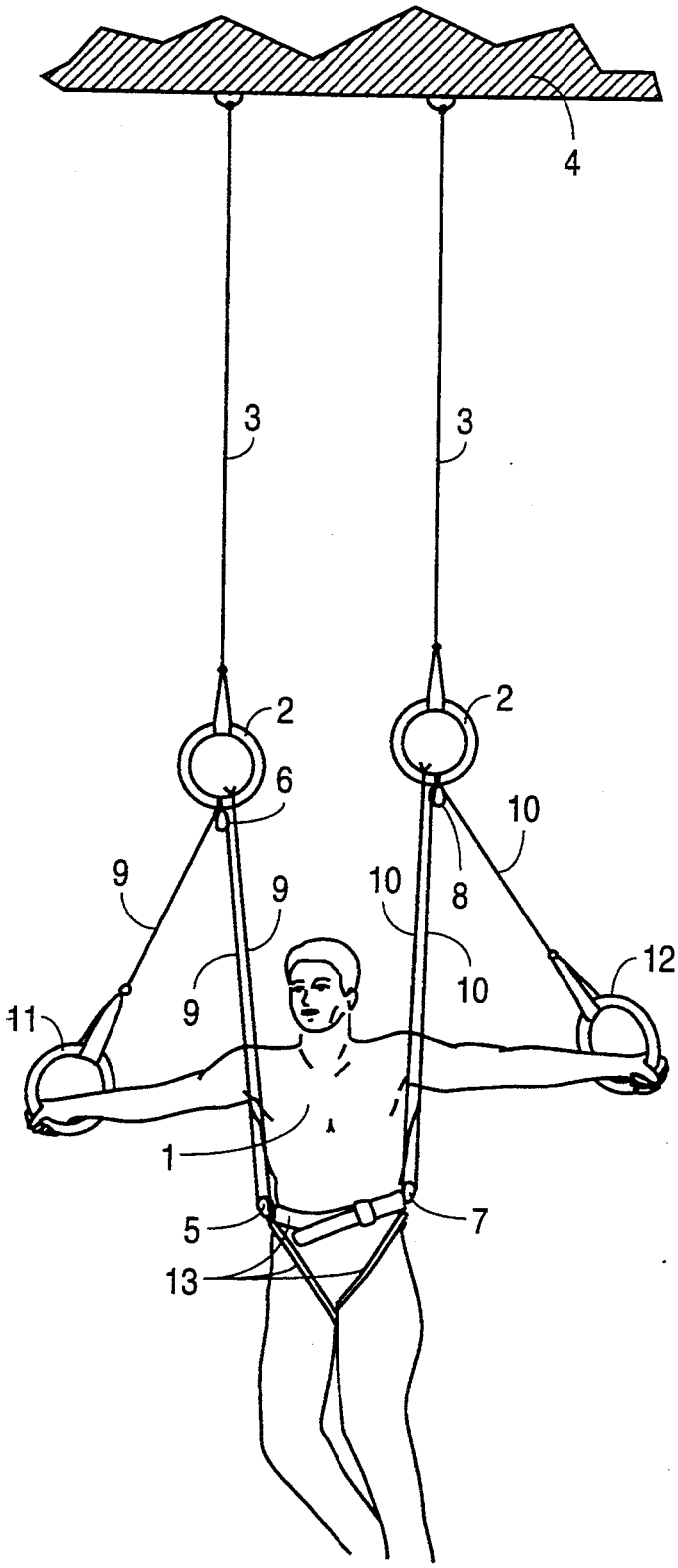
FIG. 1 (PRIOR ART)
FIG. 1 (Prior Art) shows a gymnast practicing the iron cross exercise using a pulley system rigged to a real gymnastics ring setup in accordance with the prior art.
Figure 2:
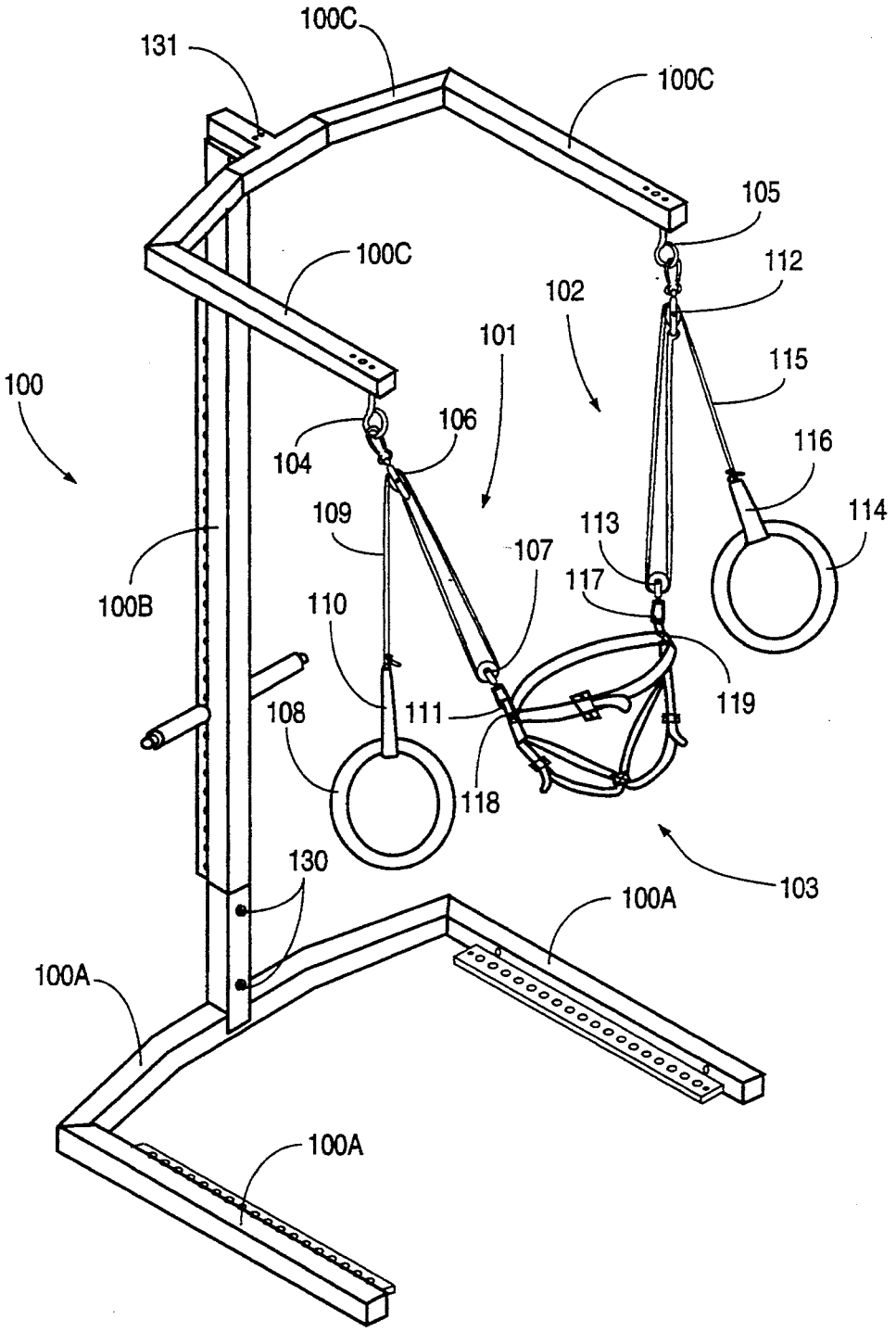
FIG. 2 is a perspective view illustrating one embodiment in accordance with the present invention.

FIG. 2 is a perspective view illustrating one embodiment of an exercise machine in accordance with the present invention. This exercise machine comprises a freestanding support frame 100, a first block and tackle pulley system 101, a second block and tackle system 102, and a body harness 103. The freestanding support frame 100 comprises a base portion 100A, a vertical support portion 100B, and an upper portion 100C. In the embodiment shown in FIG. 2, two eyebolts 104 and 105 are provided on the upper portion 100C of the freestanding support frame 100 to provide attachment points for the first and second block and tackle pulley systems to attach to the upper portion 100C of the freestanding support frame. In the embodiment shown, these attachment points are located approximately 7.5 feet above the surface upon which base portion 100A rests and are located approximately 21 inches apart.

The first block and tackle pulley system 101 comprises pulley assembly 106, pulley assembly 107, ring 108, line 109, and ring band 110. Pulley assembly 106 is connected to eyebolt 104 on the upper portion 100C of the freestanding support frame. Pulley assembly 107 is detachably connected to one side of the body harness 103 by a carabiner 111 such as is used in rock climbing. One end of line 109 is fixed to pulley assembly 106. The other end of line 109 is connected to ring 108 via ring band 110. The line 109 is operatively wrapped around pulley assembly 106 and pulley assembly 107 so that forcing ring 108 downward will result pulley assembly 107 and body harness 103 being pulled upward toward eyebolt 104. In the embodiment shown, line 109 is ¼ inch diameter, 1,000 pound test woven nylon sailing line and is approximately nine feet long.

The second block and tackle pulley system 102 is rigged in a similar manner to the first block and tackle pulley system 101. The second block and tackle pulley system 102 comprises pulley assembly 112, pulley assembly 113, ring 114, line 115, and ring band 116. Pulley assembly 112 is connected to eyebolt 105 on the upper portion 100C of the freestanding support frame. Pulley assembly 113 is detachably connected to another side of the body harness 103 by a carabiner 117. One end of line 115 is fixed to pulley assembly 112. The other end of line 115 is connected to ring 114 via ring band 116. The line 115 is operatively wrapped around pulley assembly 112 and pulley assembly 113 so that forcing ring 114 downward will result in pulley assembly 113 and body harness 103 being pulled upward toward eyebolt 105. Line 115 is the same type of line and is of the same approximate length as line 109. Pulley assemblies 106, 107, 112 and 113 are high impact plastic and stainless steel swivel-eye pulleys for use with ¼ inch rope or line.

Multiple types of body harnesses 103 can be used in accordance with the present invention. The particular body harness 103 shown in FIG. 2 is a modified rock climbing harness made of nylon. This harness has adjustable leg straps as well as an adjustable waist band. The waist band of the harness has two loops 118 and 119. When the body harness is worn, one loop is disposed on one hip and the other loop is disposed on the other hip. It is to these two loops 118 and 119 of the body harness that the first and second block and tackle pulley systems 101 and 102 detachably attach via carabiners 111 and 117, respectively. The use of carabiners allow the first and second block and tackle pulley systems to be quickly and reliably attached and detached from the body harness. A user already wearing a body harness can therefore walk up to the freestanding support frame, clip the loops 118 and 119 of the body harness to the pulley assemblies 107 and 113 of the first and second block and tackle pulley systems using the carabiners 111 and 117, grab hold of the rings 108 and 114, and power up into the iron cross position or otherwise begin exercising.

FIGS. 3A–C are views illustrating the base portion 100A of the embodiment of FIG. 2. FIG. 3A is a top down view of the base portion. FIG. 3B is a front view of the base portion. FIG. 3C is a perspective view of the base portion. Base portion 100A comprises two leg members 300 and 301 which are joined together by a joining member 302. Leg members 300 and 301 and joining member 302 are made of cut and welded 3×3 inch cold-rolled steel box tubing. An attachment member 303 of 3.5×3.5 inch cold-rolled steel box tubing having an open end which is rectangular in cross-section extends upward about 15 inches from the joining member 302. In the embodiment shown, the leg members are each approximately 36 inches long, and are disposed to extend substantially parallel to each other so that they are separated from each other by approximately 42 inches. Dimension A is approximately 40 inches.

Figure 4A:
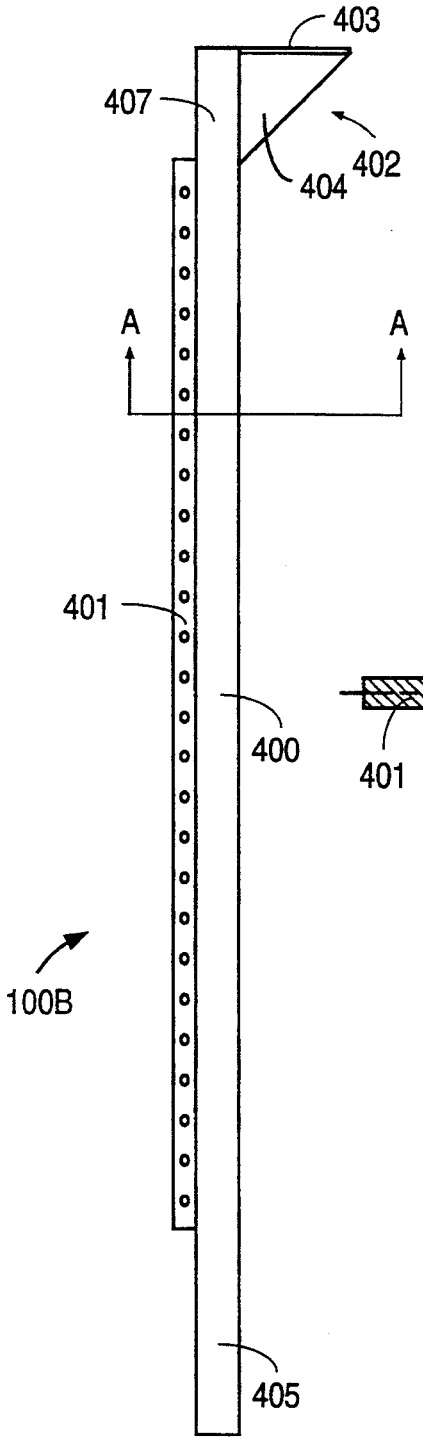
FIGS. 4A and 4B are views illustrating a vertical support portion of the embodiment of FIG. 2.
Figure 4B:
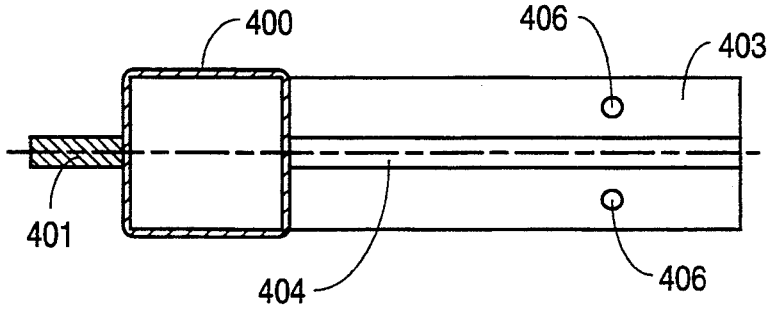

FIGS. 4A and 4B are views illustrating the vertical support portion of the embodiment of FIG. 2. FIG. 4A is a side view of the vertical support portion. FIG. 4B is a sectional view looking upward taken along sectional line A—A in FIG. 4A. Vertical support portion 100B comprises a vertical member 400, a vertical rib member 401, and a platform support member 402. In the embodiment shown in FIGS. 4A and 4B, the platform support member 402 comprises a 2.75×8.00 inch rectangular flat plate portion 403 supported by a vertical triangular reinforcing portion 404. The triangular reinforcing portion 404 extends from the vertical member 400 to the bottom of the rectangular flat plate portion 403. In the embodiment shown, vertical member 400 is an 87 inch long piece of 3×3 inch cold-rolled steel box tubing. Vertical rib member 401 is a 65 inch long piece of 1.5×⅜ inch strap metal having a plurality of 0.69 inch diameter holes. The upper end 407 of the vertical member 400 is left open.

FIGS. 5A–D are views illustrating the upper portion of the embodiment of FIG. 2. FIG. 5A is a view of the upper portion from the rear. FIG. 5B is a top down view of the upper portion. FIG. 5C is a side view of the upper portion. FIG. 5D is a perspective view of the upper portion. Upper portion 100C comprises two arm members 500 and 501 which are joined together by a substantially T-shaped joining member 502. An attachment member 503 extends downward in a vertical direction from the joining member 502. In the embodiment shown, the arm members 500 and 501 are each approximately 24 inches long, and are disposed to extend parallel to each other so that they are separated from each other by approximately 20 inches. Other separations, however, may also be practiced including separations which result in the first and second block and tackle pulley systems being connected to arm members 500 and 501 at attachment points which are separated by 16 to 28 inches. The arm members 500 and 501 and the joining member 502 are made of 2×2 inch cold-rolled steel box tubing.

The attachment member 503 is approximately 10 inches long and is made of 2.5×2.5 inch box tubing. Dimension B is approximately 35 inches. To assemble the base member 100A and the vertical support portion 100B, the bottom end 405 of the vertical support portion 100B is inserted into the open end of the attachment member 303 of the base portion 100A. Fixing bolts 130 which extend through holes in the attachment member 303 and the vertical support portion 100B are secured in place with associated fixing nuts (not shown in FIG. 2) so that the bottom end of the vertical support portion is retained in the open end of the attachment member as shown in FIG. 2. To assemble the vertical support portion 100B and the upper portion 100C, the attachment member 503 of the upper portion 100C is inserted into the upper open end 407 of the vertical member 400 so that holes 504 in the joining member 502 are aligned with corresponding holes 406 in the platform support member 402. Fixing bolts (not shown in FIG. 2) extend through the holes in the platform support member 402 and through the holes 504 in the joining member 502 and are secured in place with fixing nuts 131 as shown in FIG. 2. Disassembly is accomplished by removing the fixing bolts and nuts so that the base portion, vertical support portion, and upper portion come apart, one from another. The support frame can therefore be quickly and easily assembled and/or disassembled. The assembled support frame 100 of the embodiment shown in FIG. 2 has a maximum height of approximately 7.5 feet so that the exercise machine can be used in a room of standard eight foot ceiling height in a typical home or garage. Preferably, the assembled support frame 100 has a height of at least six feet.

In the embodiment shown in FIG. 2, two eyebolts 104 and 105 are provided as means for attaching the pulley systems 101 and 102 to the support frame. A threaded portion of eyebolt 104 is extended through a hole (not shown) in the bottom of arm member 500 of the upper portion 100C of the support frame and is secured in place by two nuts (not shown in FIG. 2) and a lock washer (not shown in FIG. 2) so that the lock washer and the arm member are sandwiched between the two nuts and so that the eye portion of the eyebolt extends downward from the bottom of the arm member 500 as shown in FIG. 2. Eyebolt 105 is connected to arm member 501 in a similar fashion.

Figure 6:
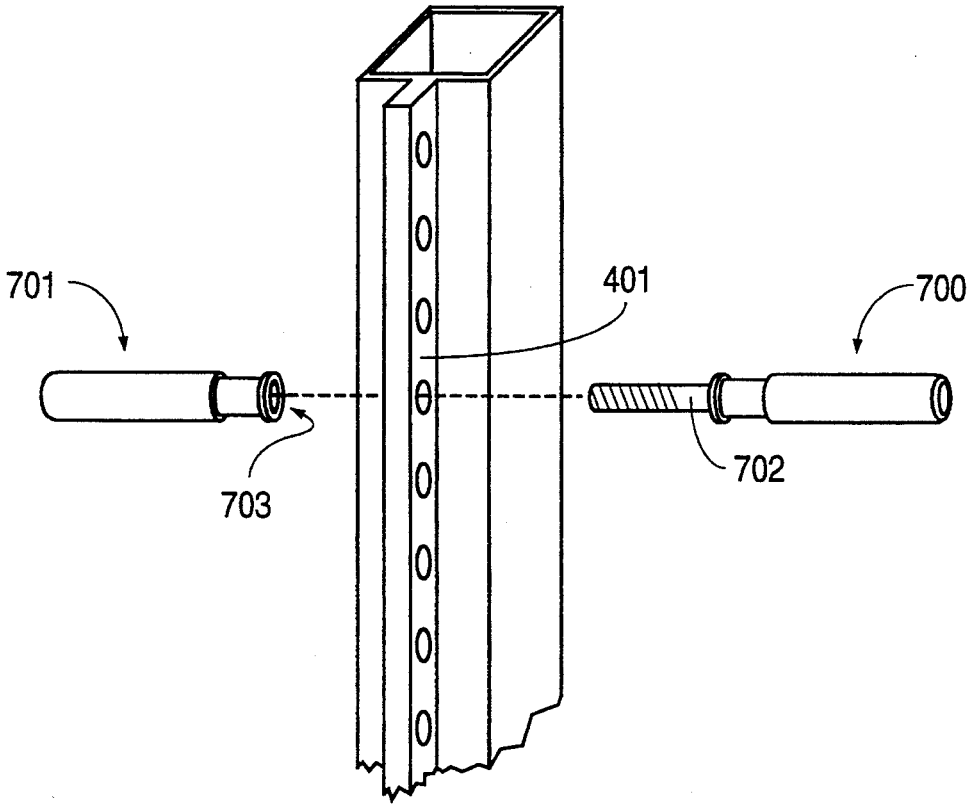
FIG. 6 is an exploded perspective view of a footrest attachment in accordance with the present invention.

FIG. 6 is an exploded perspective view of one embodiment of a footrest attachment. The footrest attachment comprises a first portion 700 and a second portion 701. The first portion has a threaded neck extension 702 which, when attached to the support frame, extends through one of the plurality of holes in the vertical rib member 401 and screws into a threaded hole 703 in the second portion. If the footrest attachment is to be set at a high position on the vertical support portion 100B, then the threaded neck extension of the first portion engages the threaded hole of the second portion through one of the plurality of holes in the rib member located high on the rib member. If, on the other hand, the footrest attachment is to be set at a lower position on the vertical support portion 100B, then the threaded neck extension of the first portion engages the threaded hole of the second portion through one of the plurality of holes in the rib member located lower on the rib member. The footrest attachment is therefore adjustable in the vertical dimension and is located such that the feet of a user can be supported by the footrest attachment when the user is exercising using the block and tackle pulley systems. In the embodiment shown, the footrest attachment is cylindrically shaped, is approximately 14 inches long, and has an outer diameter of approximately 1.125 inches. Both the first and the second portions of the footrest attachment are provided with a 3/16 inch thick outer cylindrical sheath of protective foam rubber.

Figure 7:
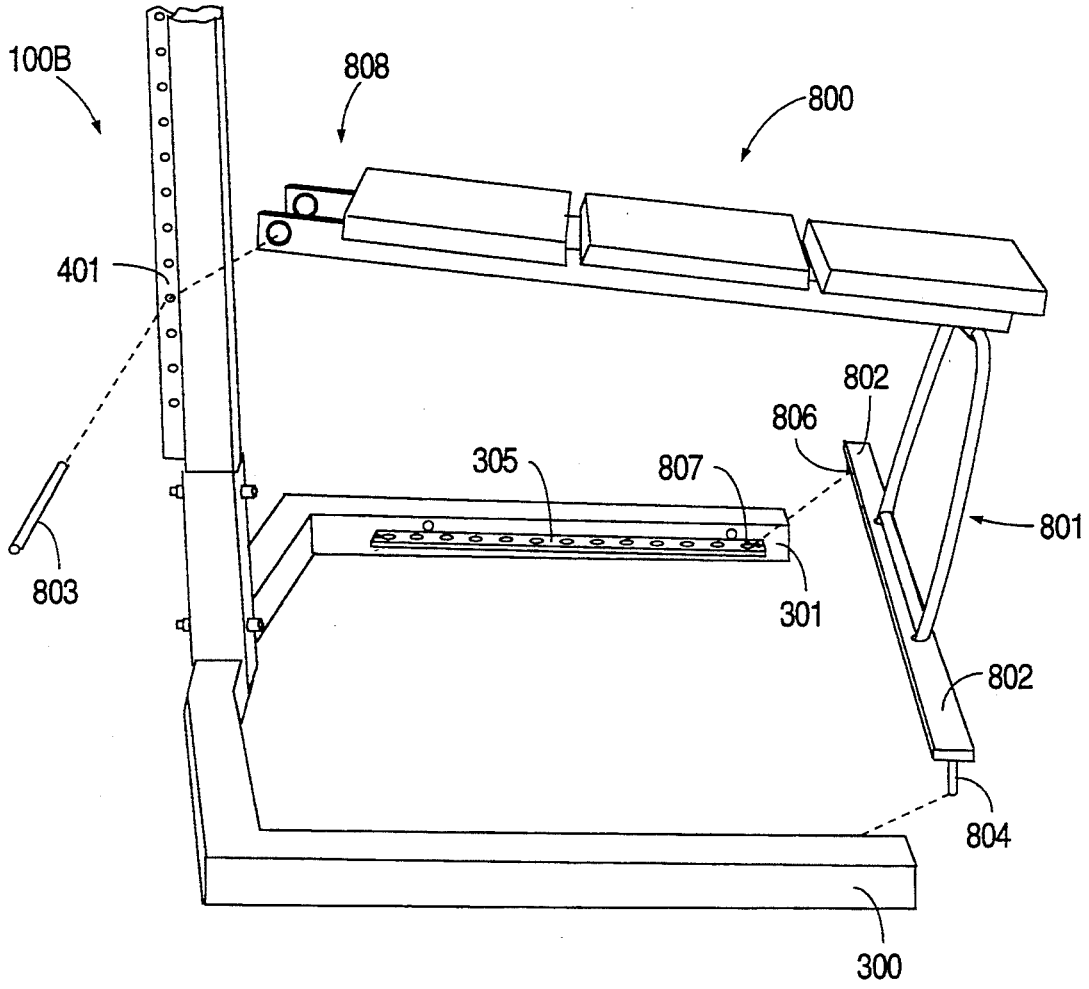
FIG. 7 is an exploded perspective view of a bench attachment in accordance with the present invention.

FIG. 7 is an exploded perspective view of one embodiment of a bench attachment. The bench attachment comprises a padded bench member 800, a leg member 801, a cross-bar member 802, and a pin member 803. To attach the bench attachment to the frame support 100, a pin 804 on the bottom of the cross-bar member 802 engages a corresponding hole in a first attachment bar (not shown in FIG. 7) on the first leg 300 of the bottom portion 100A of the support frame 100. Similarly, another pin 806 on the bottom of the cross-bar member 802 engages another corresponding hole 807 in a second attachment bar 305 on the second leg 301 of the bottom portion 100A of the support frame 100. A hinge-type joint between the padded bench member 800 and the leg member 801 can pivot to a number of suitable angles. Pin member 803 connects the head end 808 of the padded bench member 800 to the rib member 401 of the vertical support portion 100B. Accordingly, if the head end 808 of the padded bench member is to be attached high on the vertical support portion, the pin member 803 extends through a hole located high on the rib member. If, on the other hand, the head end 808 of the padded bench member is to be attached lower on the vertical support portion, the pin member 803 extends through a hole located lower on the vertical support portion. The bench attachment is therefore fully and adjustable and can be a horizontal bench or an inclined bench.

Figure 8:
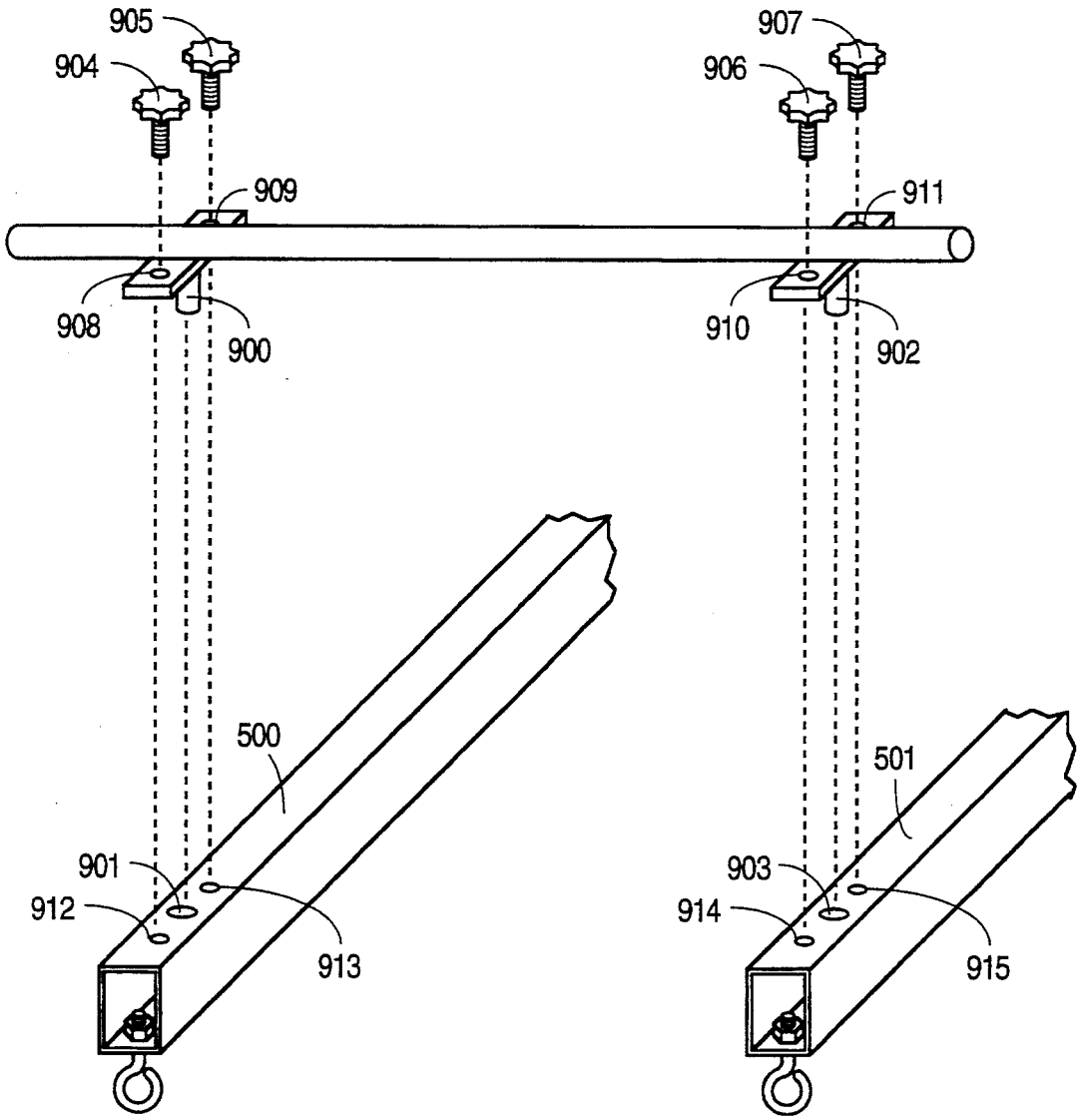
FIG. 8 is an exploded perspective view of a pull-up bar attachment in accordance with the present invention.

FIG. 8 is an exploded perspective view of one embodiment of a pull-up bar attachment. To attach the pull-up bar attachment to the support frame, a pin 900 on the bottom of the pull-up bar attachment engages a corresponding hole 901 in the top of the arm 500 of the upper portion 100C of the support frame. Similarly, another pin 902 on the bottom of the pull-up bar attachment engages another corresponding hole 903 in the top of the arm 501 of the upper portion 100C of the support frame. Threaded largeheaded hand bolts 904–907 extend through holes 908–911 in the pull-up attachment bar and engage corresponding holes 912–915 in threaded ¼–20 inserts in the top of the arms 500 and 501 to secure the pull-up attachment bar attachment in place on the top of the upper portion of the support frame. In the embodiment shown, the pull-up bar is approximately 1.125 inches in diameter and is made of cold-rolled steel tubing. The threaded largeheaded hand bolts 904–907 have relatively large diameter plastic heads for ease of screwing and unscrewing. Alternatively, the largeheaded hand bolts may be replaced with ¼–20 Allenhead bolts where reducing cost of the exercise machine takes precedence over the ease of removing and attaching of the pull-up attachment bar.

Figure 9:
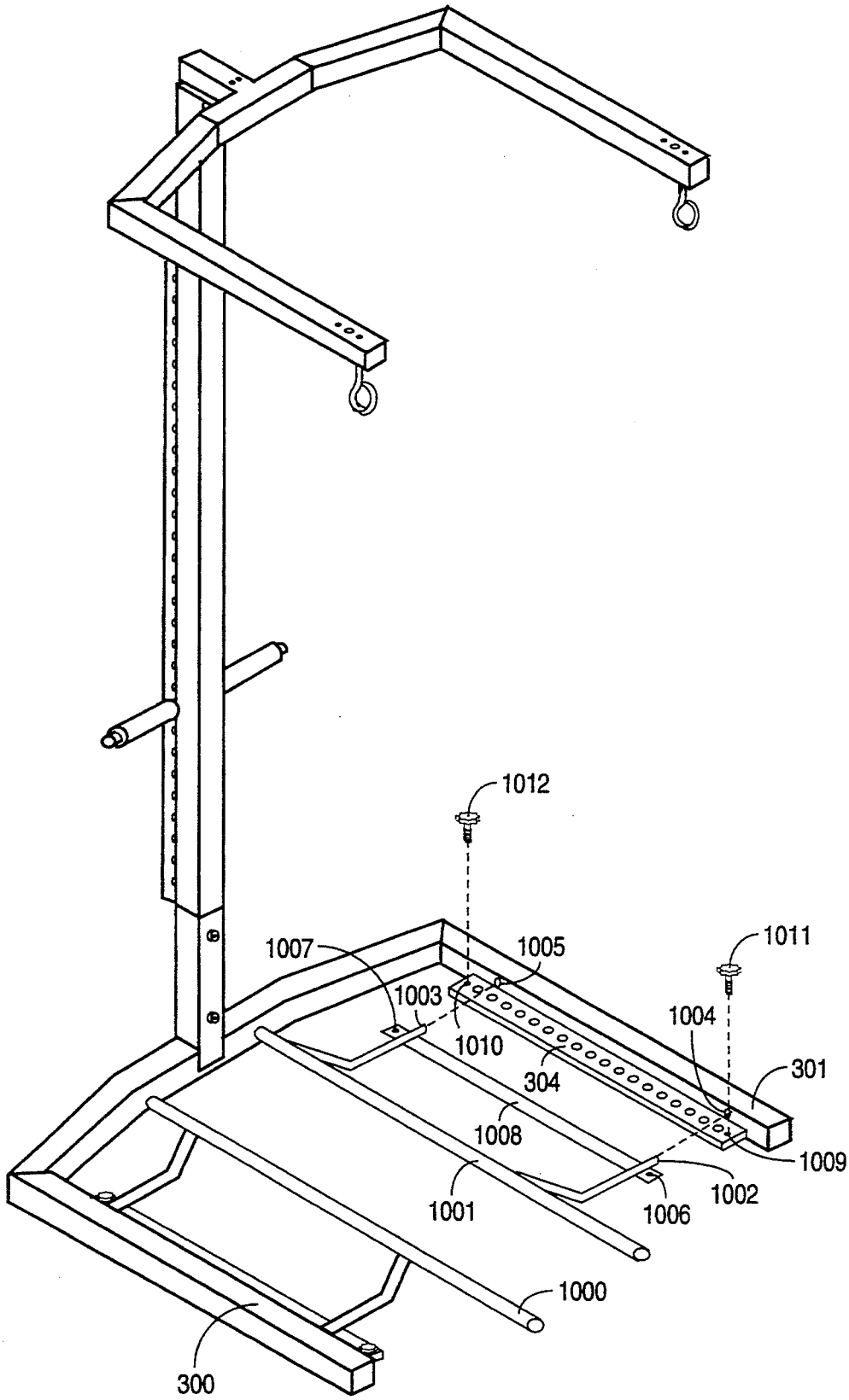
FIG. 9 is a partially-exploded perspective view of a parallel bar attachment in accordance with the present invention.

FIG. 9 is a partially-exploded perspective view of a parallel bar attachment. The parallel bar attachment comprises two parallel bars 1000 and 1001. Parallel bar 1001 attaches to leg 301 of the base portion 100A of the support frame. Rod extensions 1002 and 1003 slide into holes 1004 and 1005 in leg 301, respectively, so that holes 1006 and 1007 in a strap portion 1008 of the parallel bar 1001 line up with threaded holes 1009 and 1010 in the attachment bar 304 of leg 301, respectively. Two threaded largeheaded hand bolts 1011 and 1012 extend through holes 1006 and 1007 in the strap portion 1008 of the parallel bar, respectively, and engage the respective threaded holes 1009 and 1010 in the attachment bar 304 to secure the parallel bar in place. Parallel bar 1000 attaches to leg 300 of the base portion 100A of the support frame in the same way. In the embodiment shown, parallel bars 1000 and 1001 are made of 1½ diameter, 11 gauge steel tubing. The rod extensions of the parallel bars are made of ¾ inch diameter steel. The rod extensions are angled upward so that the parallel bars when attached to the support frame are disposed approximately 6–12 inches above the ground surface upon which base portion 100A rests. The threaded largeheaded hand bolts are of the same type as the threaded largeheaded hand bolts 904–907 usable with the pull-up attachment of FIG. 9. Alternatively, Allenhead bolts may be used.

Figure 10:
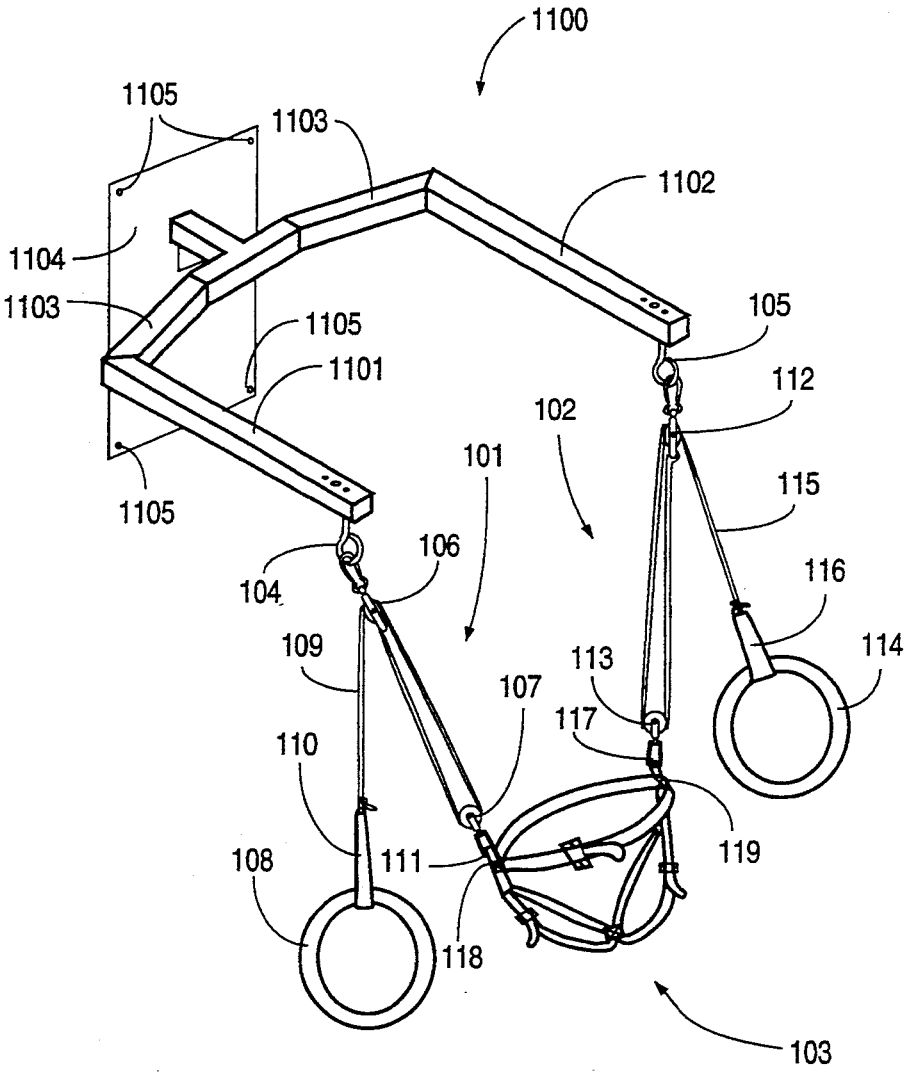
FIG. 10 is a perspective view of an embodiment of the present invention which comprises a wall attachment.

FIG. 10 is a perspective view of an embodiment in accordance with the present invention which comprises a wall attachment 1100 for suspending a first block and tackle pulley system 101 and a second block and tackle pulley system 102. The wall attachment of the present invention can take many different forms. FIG. 10 shows but one example of the wall attachment. This particular wall attachment has two arm members 1101 and 1102 as well as a joining member 1103. Joining member 1103 is fixed to a metal plate 1104. The metal plate 1104 has numerous holes 1105 with which the wall attachment 1100 can be screwed or bolted or otherwise attached to a wall.

EXERCISES

The exercises illustrated below in FIGS. 11–21 are but some of the many exercises performable on the embodiment of the exercise machine of the present invention shown in FIG. 2.

Figure 11A:
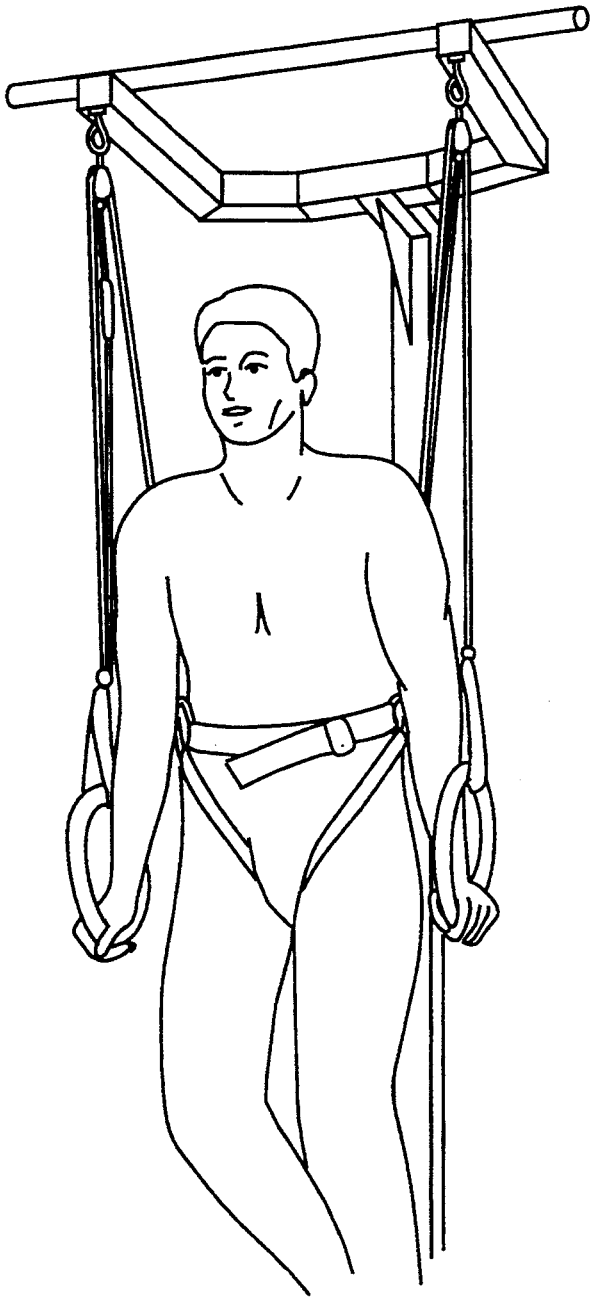
FIGS. 11A and 11B are perspective views of a user doing an iron cross exercise using the present invention.
Figure 11B:
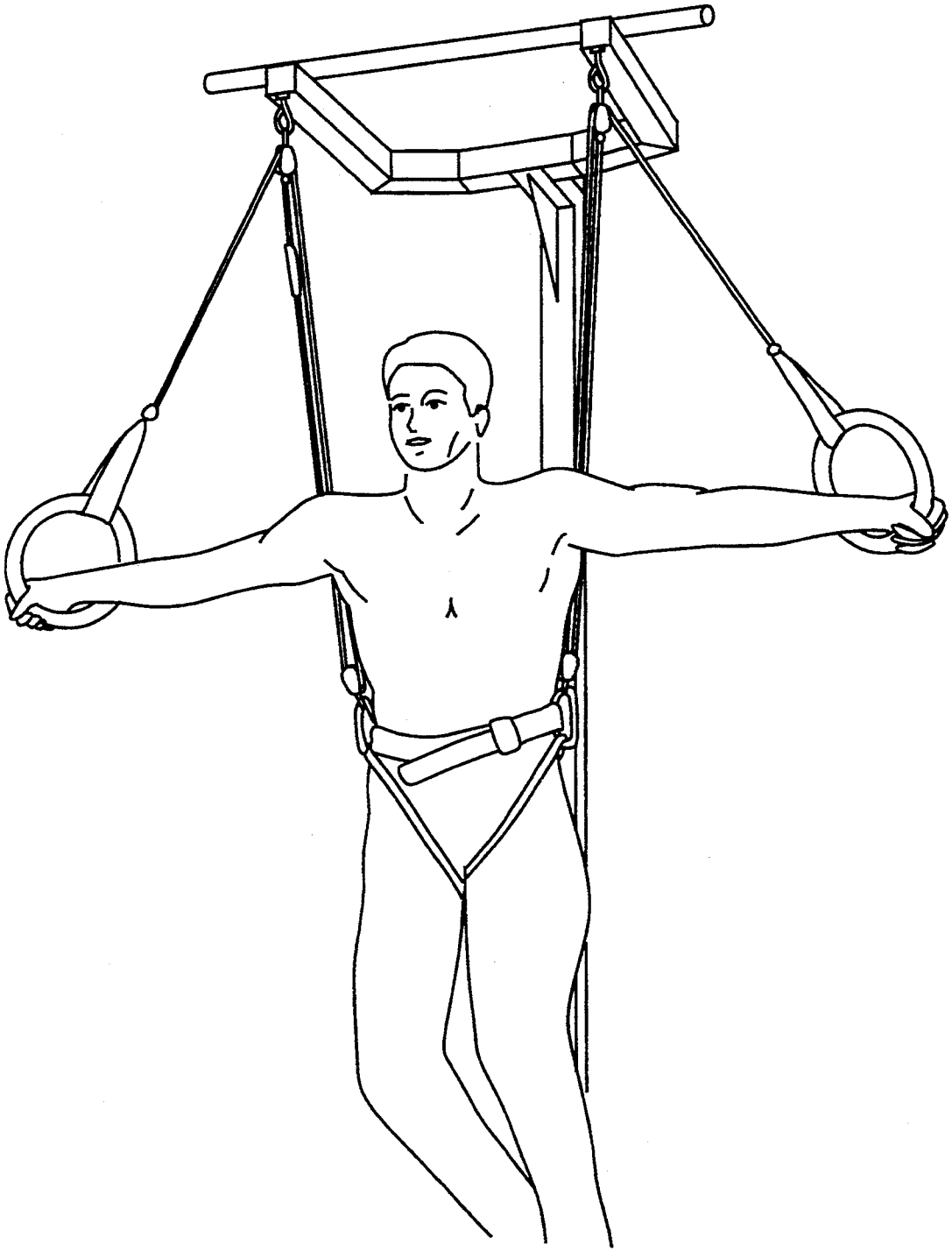

FIGS. 11A and 11B are perspective views of a user doing an iron cross exercise using the present invention.

Figure 12A:
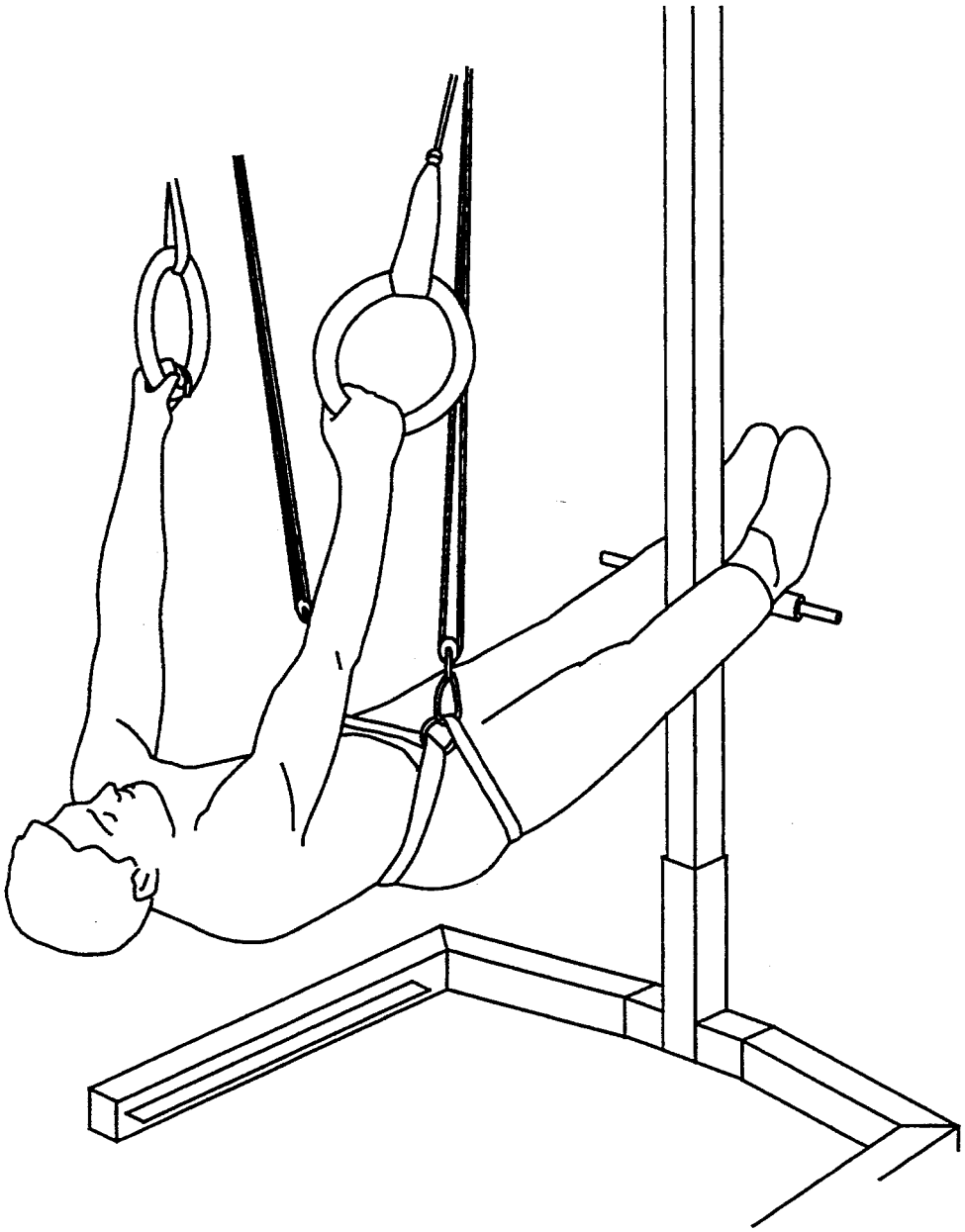
FIGS. 12A and 12B are perspective views of a user doing a horizontal pull-up exercise using the present invention.
Figure 12B:
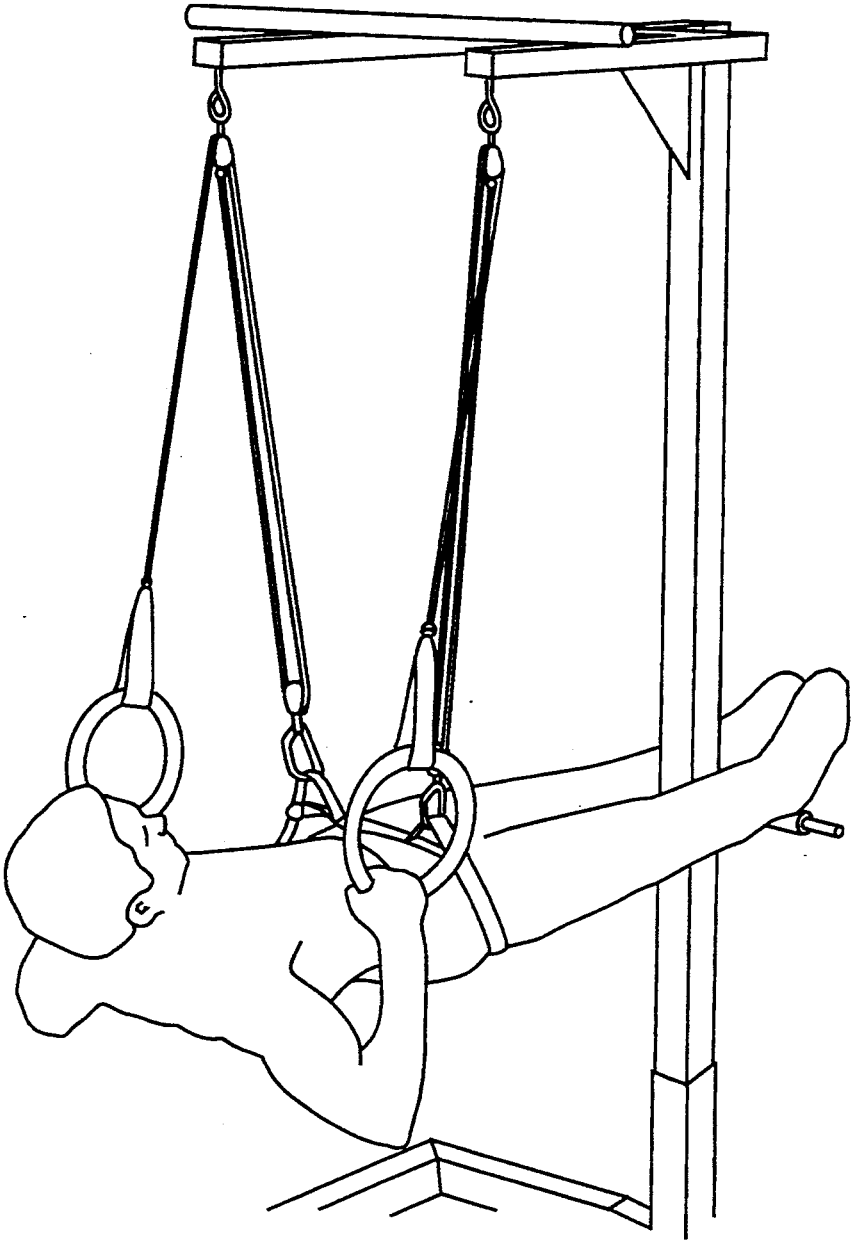

FIGS. 12A and 12B are perspective views of a user doing a horizontal pull-up exercise using the present invention.

Figure 13A:
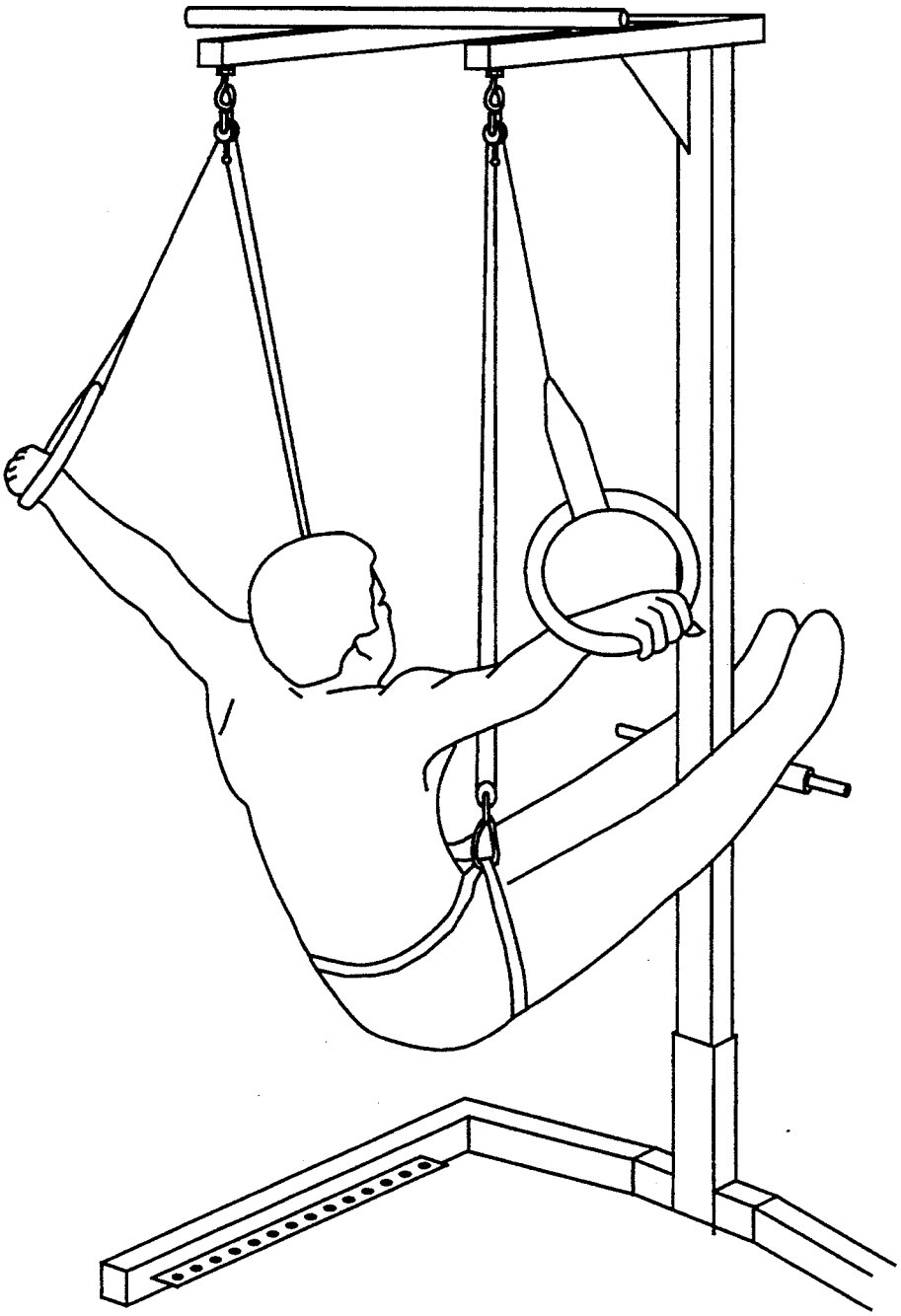
FIGS. 13A and 13B are perspective views of a user doing an iron L-seat exercise using the present invention.
Figure 13B:
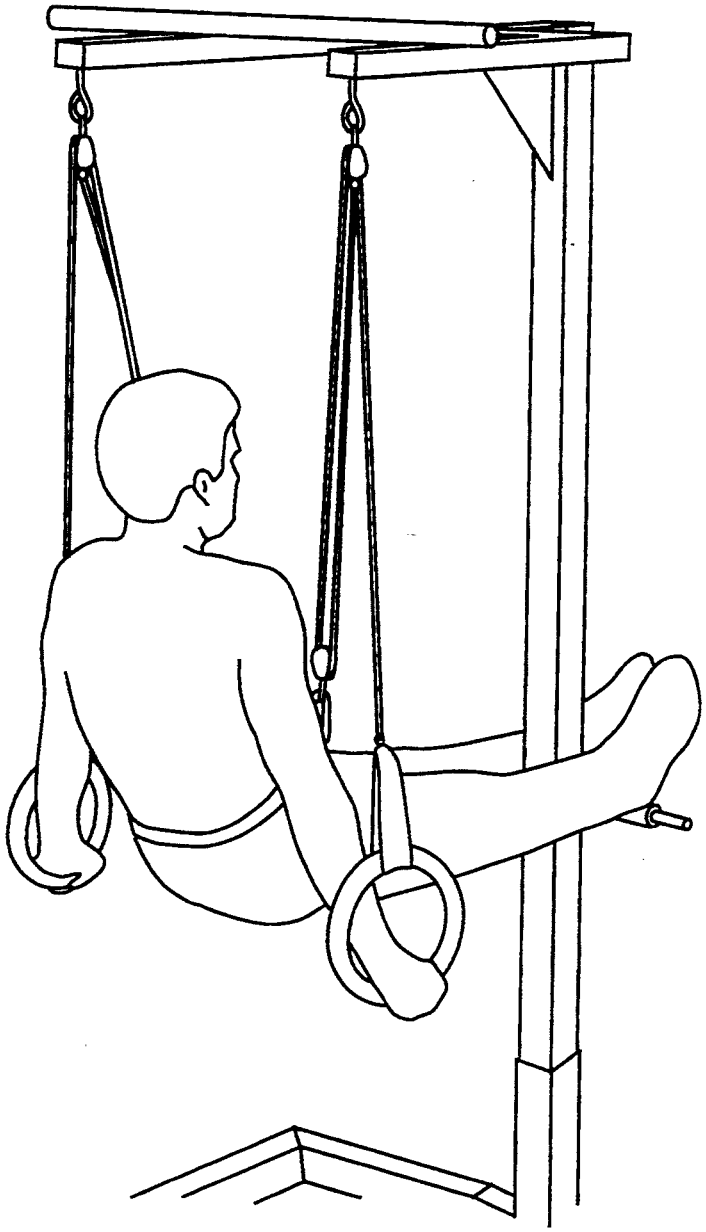

FIGS. 13A and 13B are perspective views of a user doing an iron L-seat exercise using the present invention.

Figure 14A:
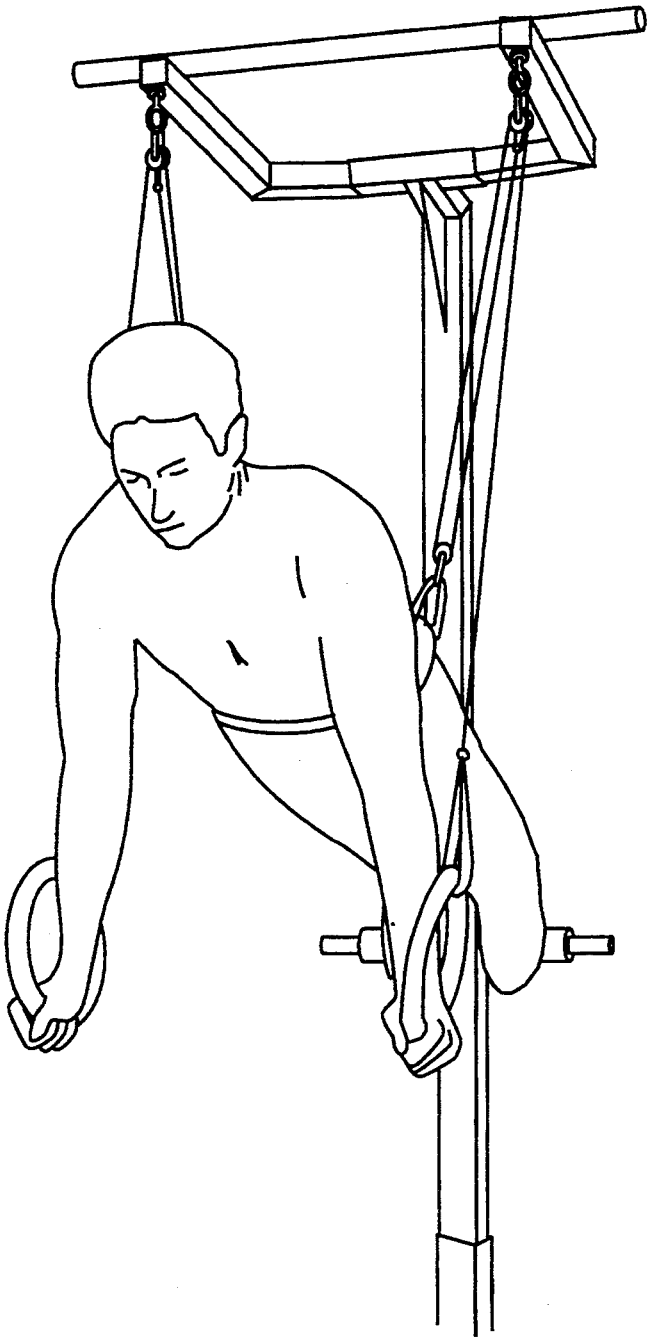
FIGS. 14A and 14B are perspective views of a user doing a straight-armed overhead lat pushup exercise using the present invention.
Figure 14B:
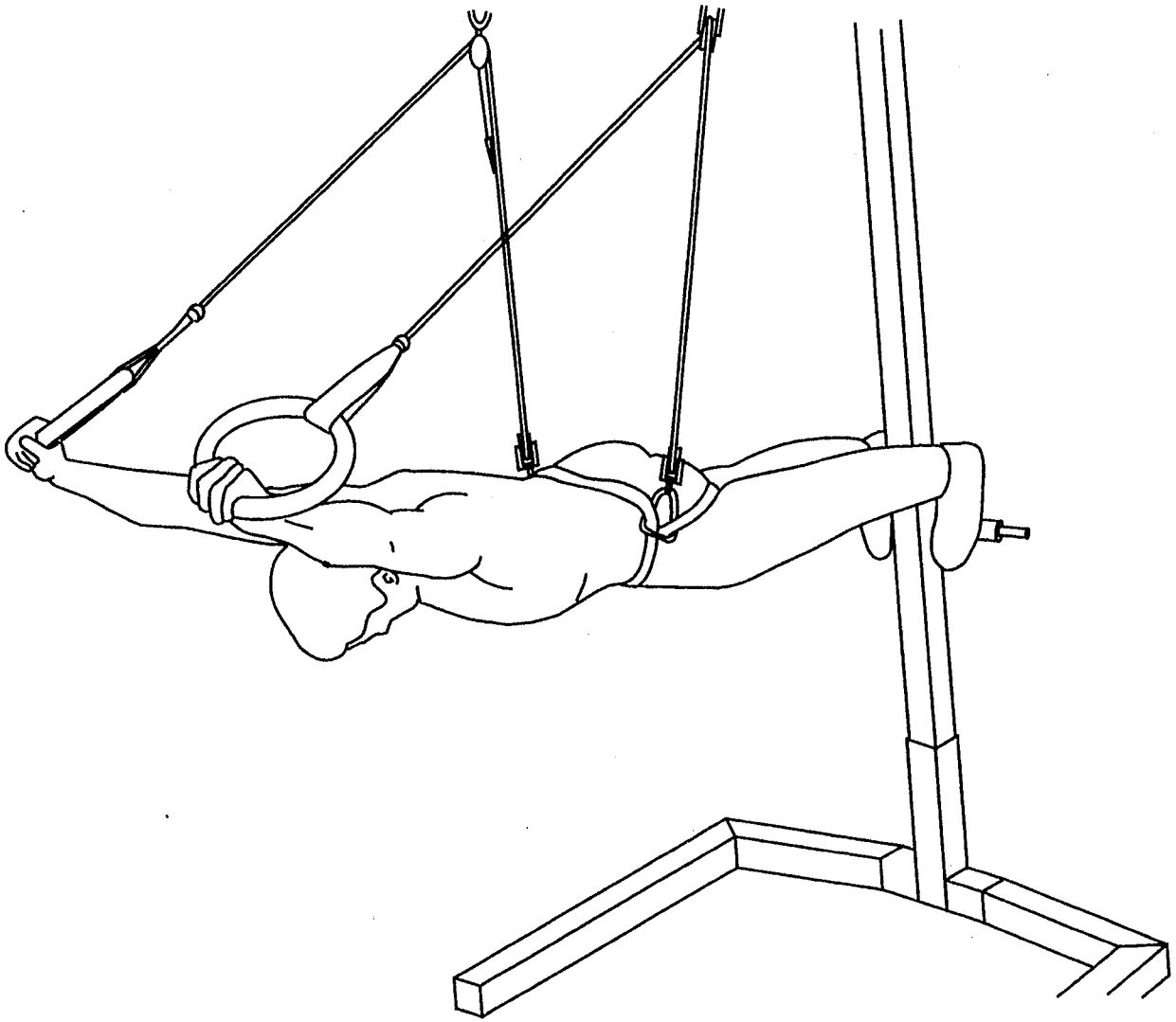

FIGS. 14A and 14B are perspective views of a user doing a straight-armed overhead lat pushup exercise using the present invention.

Figure 15:
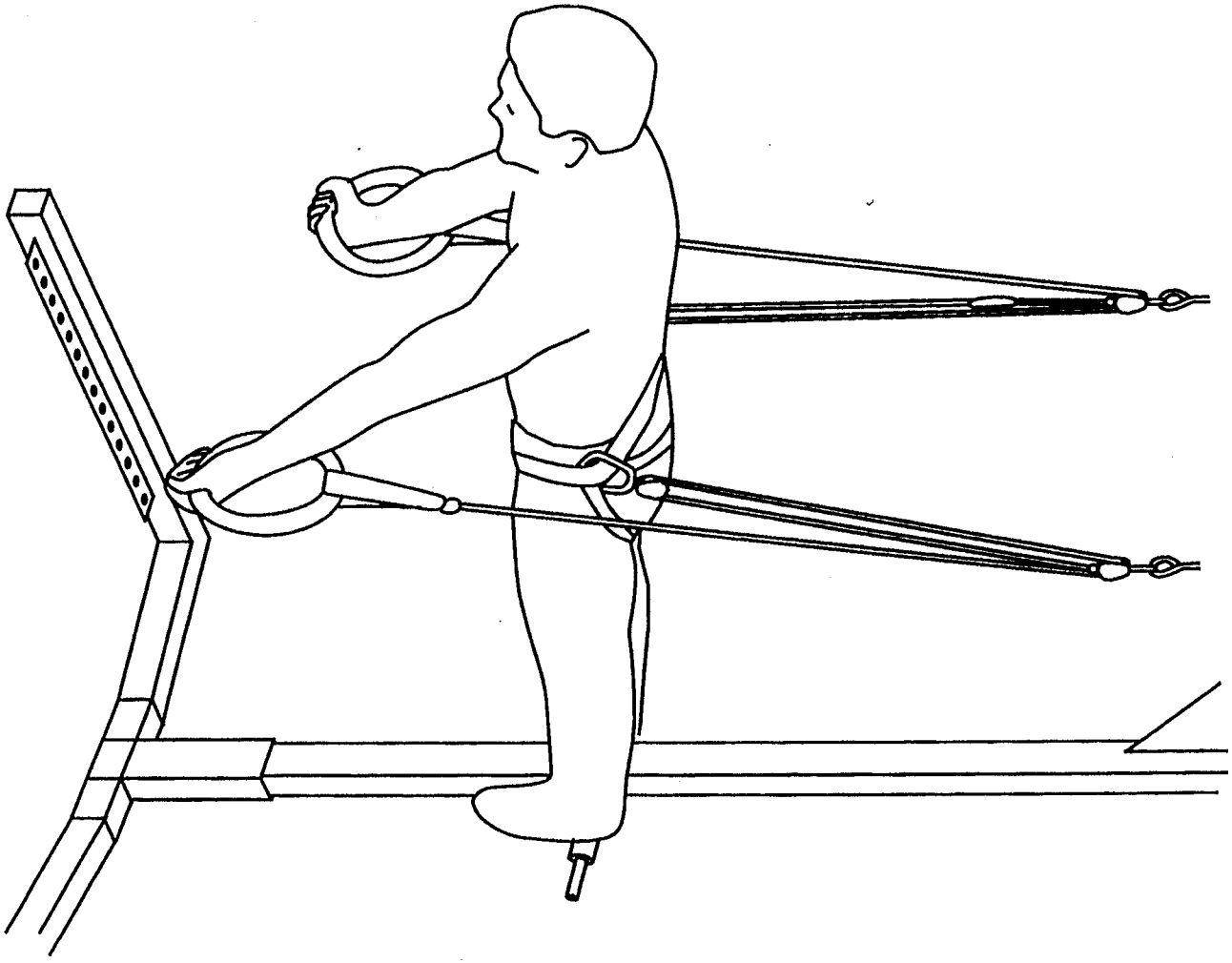
FIG. 15 is a perspective view of a user doing another exercise using the present invention.

FIG. 15 is a perspective view of a user doing another exercise using the present invention.

Figure 16A:
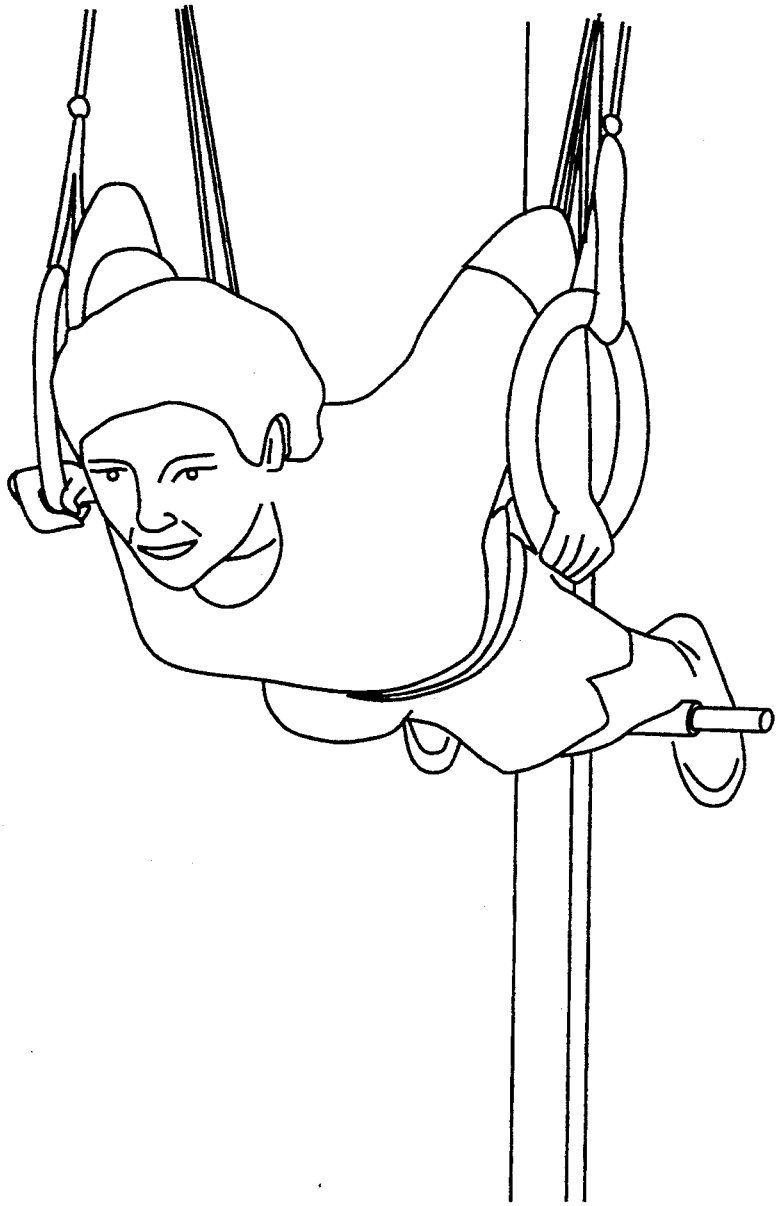
FIGS. 16A and 16B are perspective views of a user doing horizontal pushup exercise using the present invention.
Figure 16B:
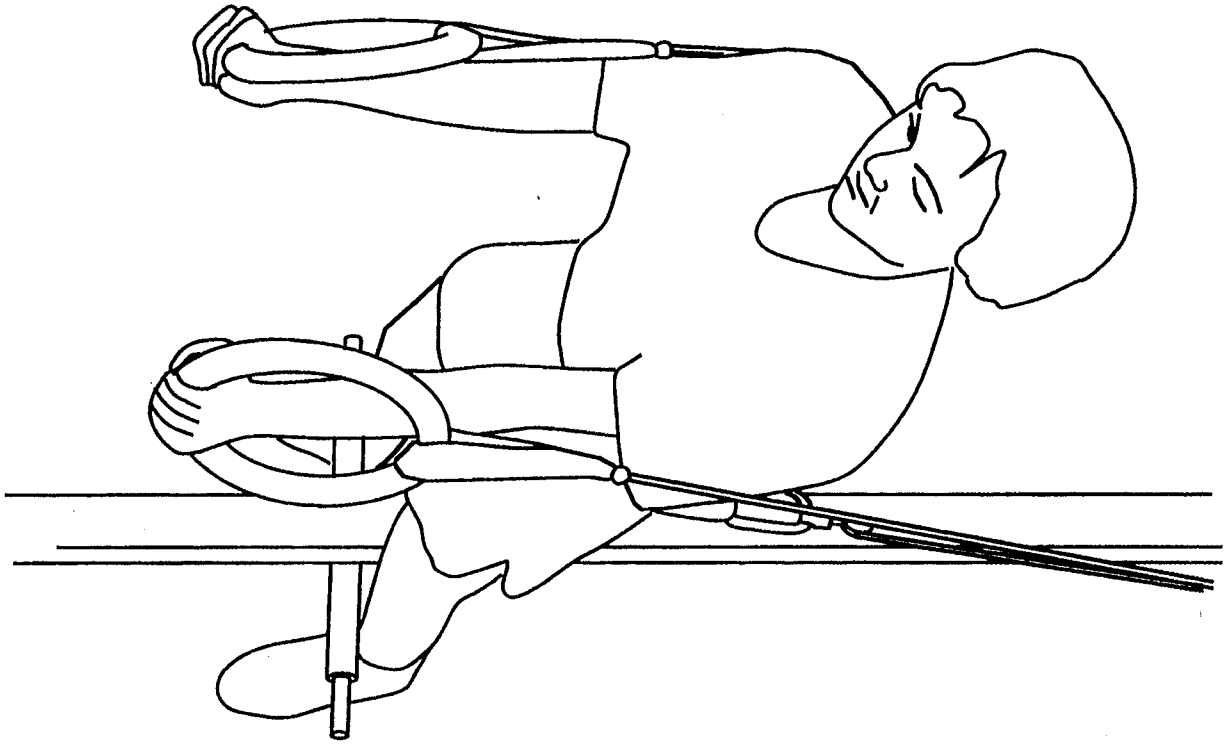

FIGS. 16A and 16B are perspective views of a user doing horizontal exercise pushup using the present invention.

Figure 17A:
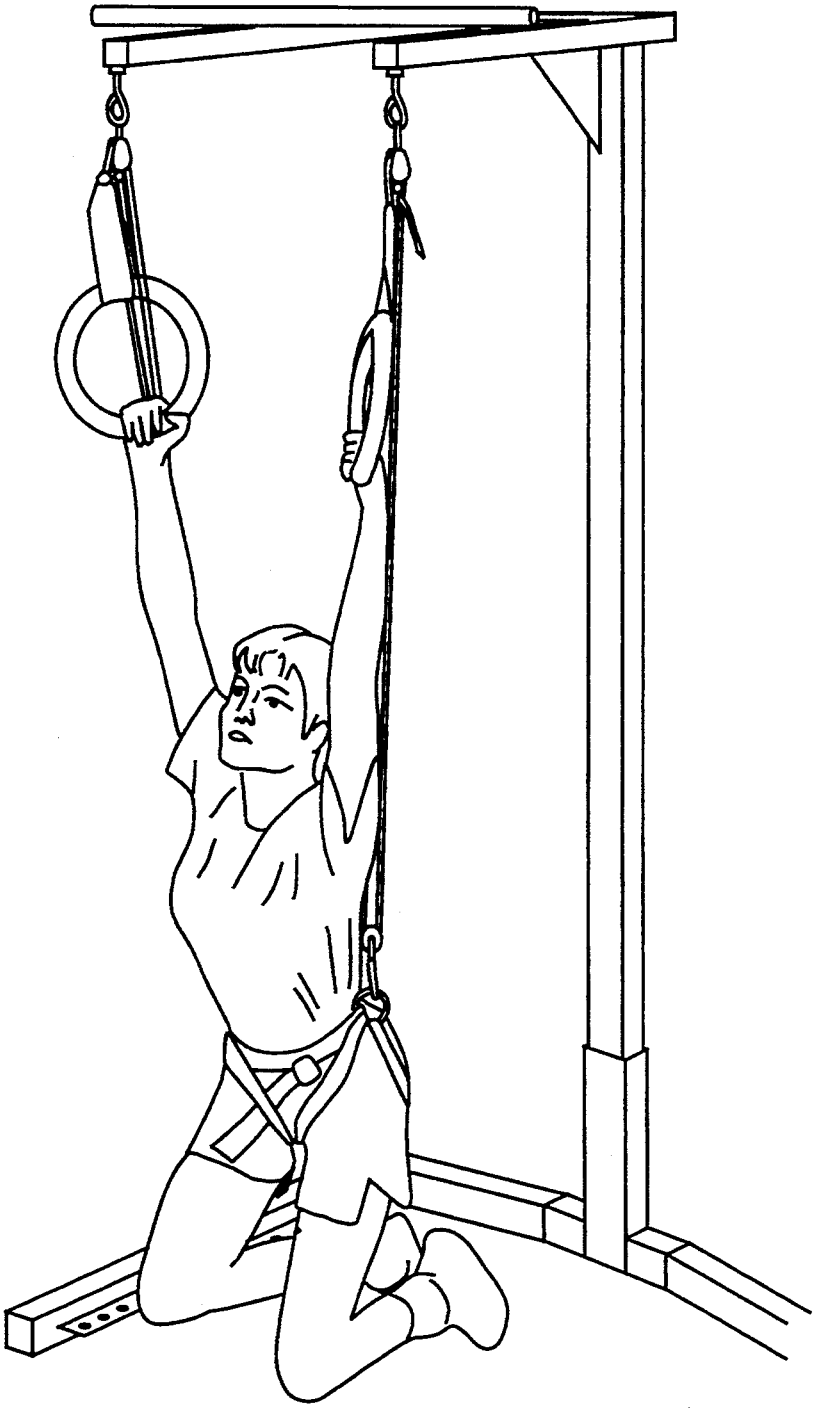
FIGS. 17A and 17B are perspective views of a user doing a vertical pull-up exercise using the present invention.
Figure 17B:
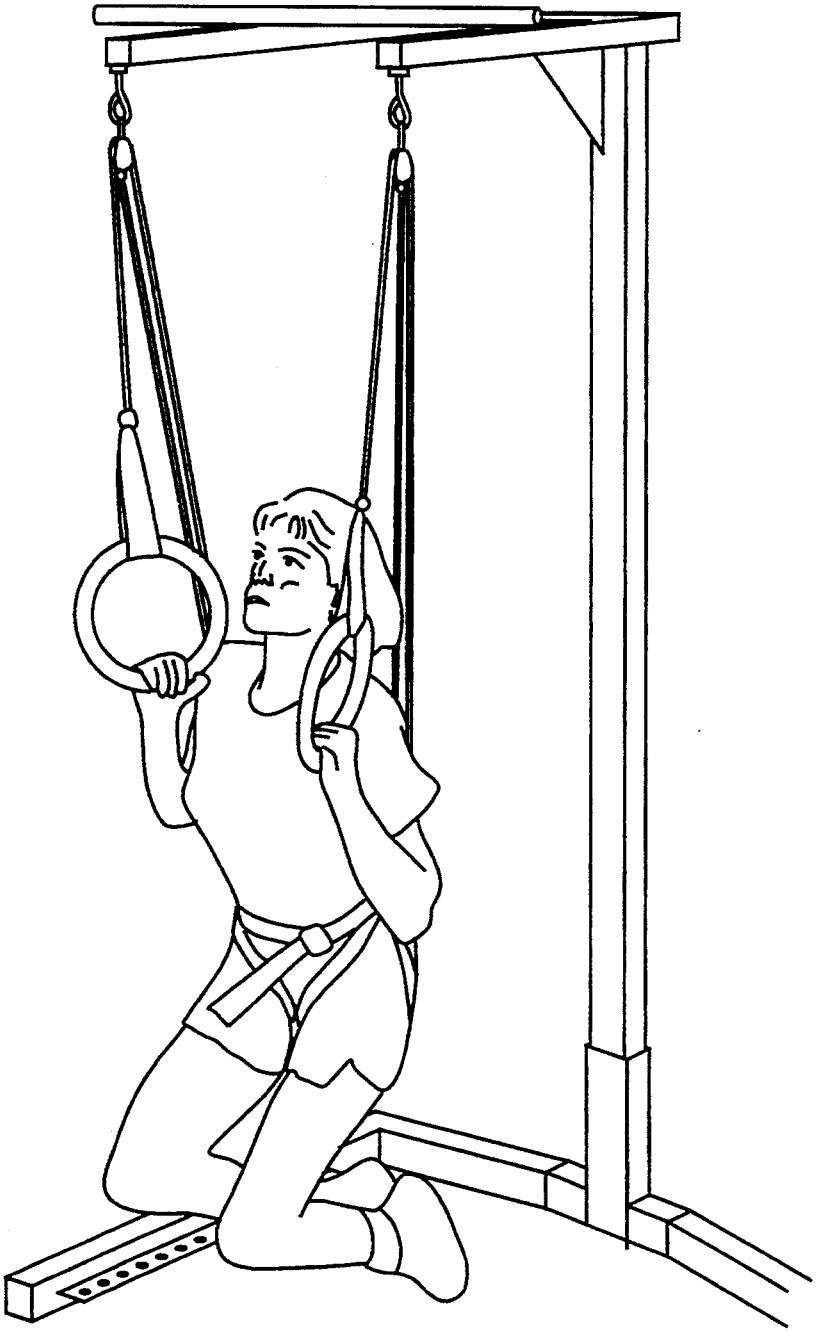

FIGS. 17A and 17B are perspective views of a user doing a vertical pull-up exercise using the present invention.

Figure 18:
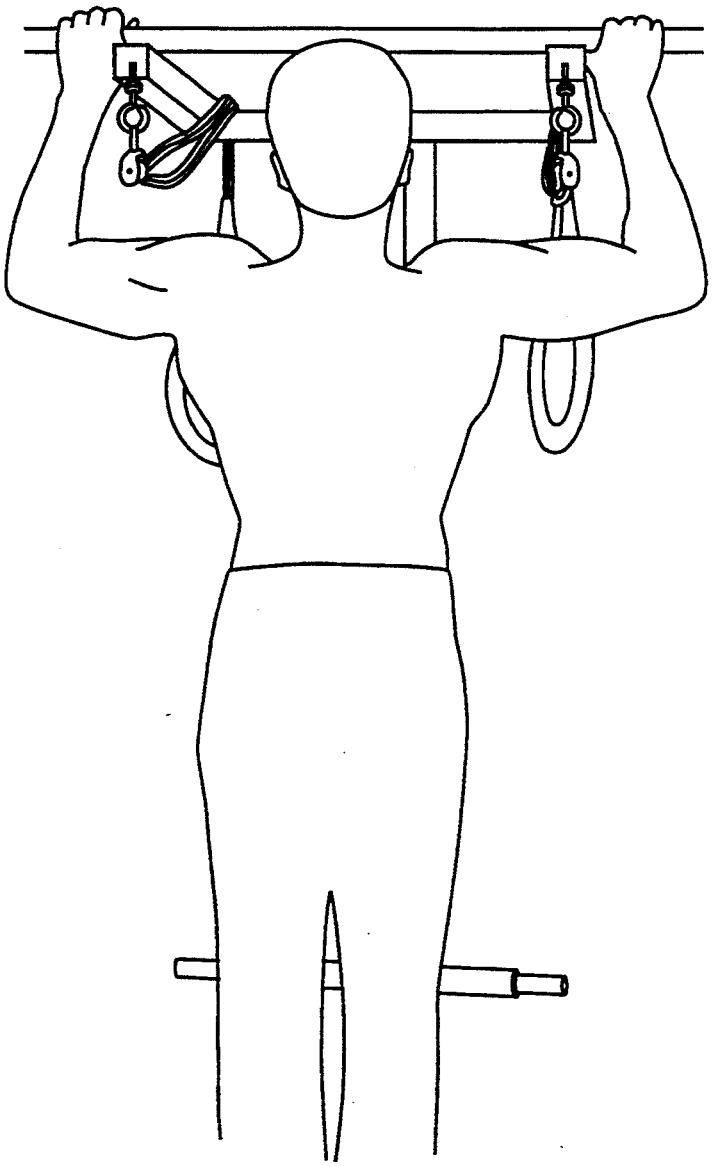
FIG. 18 is a perspective view of a user doing a pull-up using a pull-up bar attachment in accordance with the present invention.

FIG. 18 is a are perspective view of a user doing a pull-up using a pull-up bar attachment in accordance with the present invention.

Figure 19:
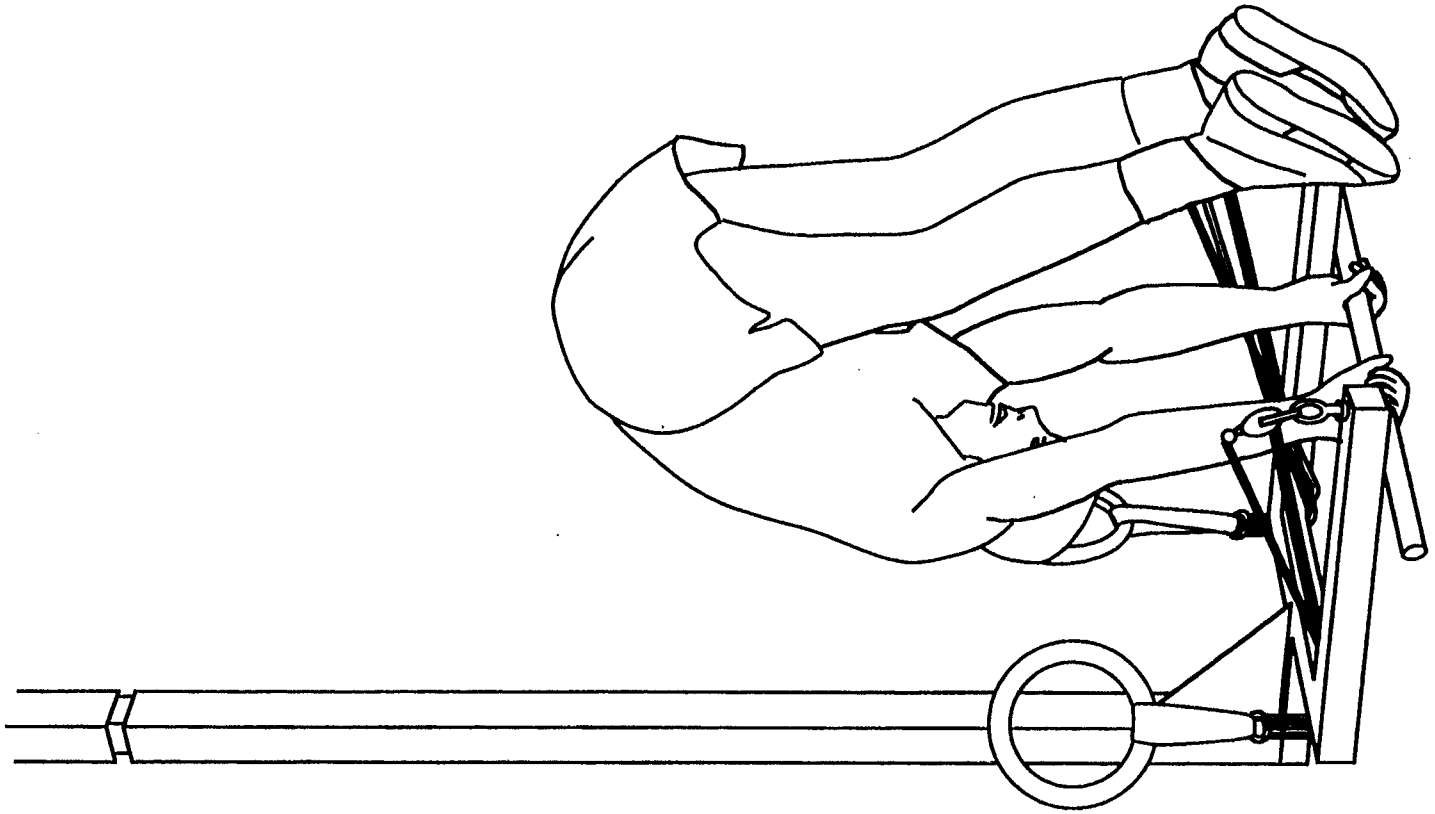
FIG. 19 is a perspective view of a user doing "leg lifts" using a pull-up bar attachment in accordance with the present invention.

FIG. 19 is a perspective view of a user doing "leg-lifts" using a pull-up bar attachment in accordance with the present invention.

Figure 20A:
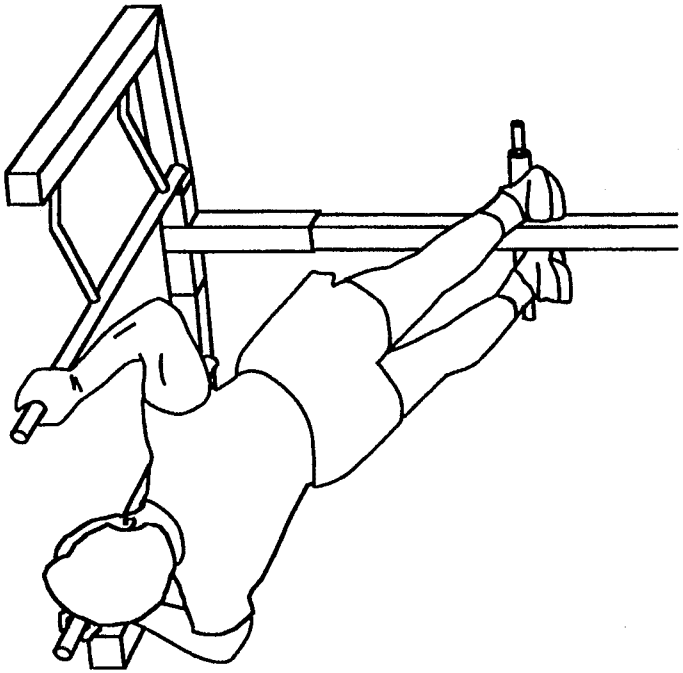
FIGS. 20A and 20B are perspective views of a user doing a pushup using a parallel bar attachment in accordance with the present invention.
Figure 20B:
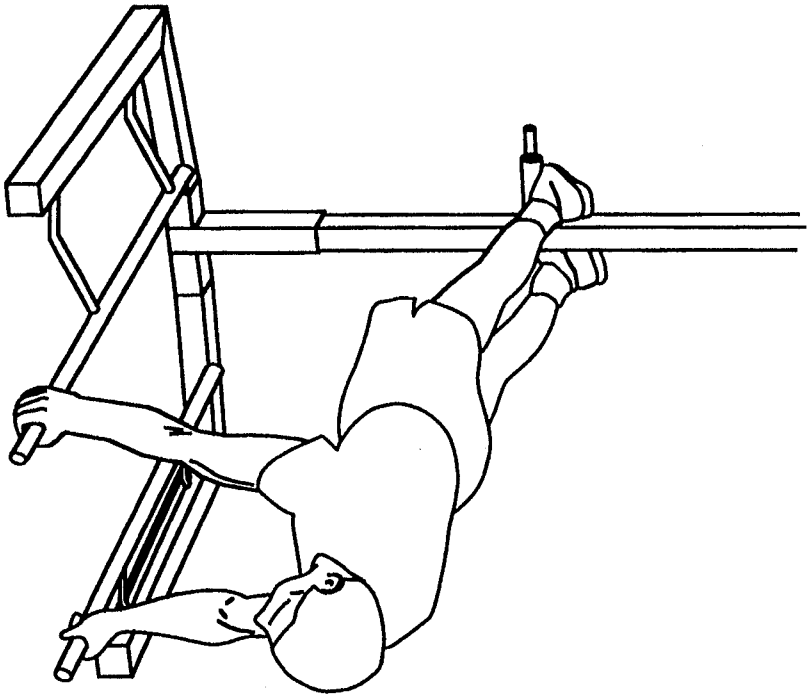

FIGS. 20A and 20B are perspective views of a user doing a pushup using a parallel bar attachment in accordance with the present invention.

Figure 21:
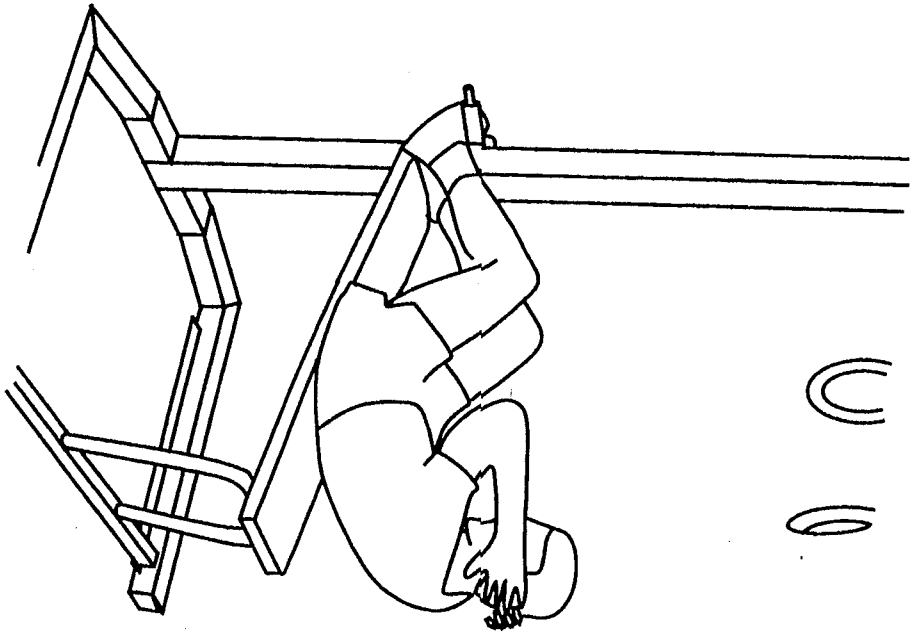
FIG. 21 is a perspective view of a user doing a situp using a bench attachment in accordance with the present invention.

FIG. 21 is a perspective view of a user doing a situp using a bench attachment in accordance with the present invention.

Although the present invention has been described in connection with certain exemplary embodiments, the present invention is not limited thereto. The present invention may be incorporated onto and may be used in combination with other exercise machines. For example, the support frame of the present invention may take on many suitable shapes, sizes and forms. Moreover, any suitable means for exerting a force on the line of a block and tackle pulley system may be used. Gymnastics rings need not be used as the means for exerting a force on the line. The element called a "block and tackle pulley system" may also be modified to have other forms and characteristics so long as a user of the exercise machine can realize a mechanical advantage to lift himself/herself under his/her own muscle power using the "block and tackle pulley system" element. In some embodiments, the first and second block and tackle pulley systems may use a single piece of line, a first handle being attached to a first end of the single piece of line, a second handle being attached to the second end of the single piece of line. In some embodiments, only a single block and tackle pulley system is used in combination with a support frame and a body harness, a handle of the single block and tackle pulley system being fashioned so that two hands can easily grasp the handle and exert a force on a line of the single block and tackle pulley system.

It is also to be understood, that although the footrest, bench, pull-up, and parallel bar are described in connection with certain exemplary attachments, that the footrest, bench, pull-up and parallel bar features are not limited to the particular attachments illustrated. Although the particular footrest described and illustrated is a cylindrically shaped attachment, the invention may comprise a footrest which is permanently fixed to the exercise machine and which has a shape other than a cylindrical shape. Some footrests of the invention may be adjustable in the vertical dimension whereas others may not be adjustable in the vertical dimension. Although a pull-up bar attachment is described and illustrated, the pull-up bar feature of the present invention is not limited thereto. The invention may comprise a pull-up bar which is a fixed and permanent part or even an integrally formed part of the exercise machine. Although a bench attachment is described in connection with the present invention, it is to be understood that the present invention may comprise a bench which is permanently fixed to the exercise machine. The bench may or may not be adjustable in the vertical dimension so as to form an inclined bench or a horizonal bench. Although the parallel bar feature of the present invention is described and illustrated as a parallel bar attachment, the present invention may comprise any one of a number of different parallel bars. The parallel bars may, for example, be permanently fixed to the exercise machine.

It is to be understood, therefore, that various changes, modifications, and adaptations of the above described embodiments may be practiced without departing from the scope of the invention as set forth in the appended claims.

I claim:

1. An exercise machine, comprising:

a support frame comprising a base portion, a vertical support portion, and an open-ended upper portion having a first end and a second end;

a first block and tackle pulley system hanging from said first end of said open-ended upper portion of said support frame, said first block and tackle pulley system comprising a first pulley connected to said first end of said open-ended upper portion, said first pulley being disposed less than approximately one foot from said first end of said open-ended upper portion, a second pulley, a flexible line operatively disposed with respect to said first and second pulleys, and a first handle connected to an end of said flexible line;

a second block and tackle pulley system hanging from said second end of said open-ended upper portion of said support frame, said second block and tackle pulley system comprising a third pulley connected to said second end of said open-ended upper portion, said third pulley being disposed less than approximately one foot from said second end of said open-ended upper portion, a fourth pulley, a flexible line operatively disposed with respect to said third and fourth pulleys, and a second handle connected to an end of said flexible line; and a body harness connected to said second pulley of said first block and tackle pulley system, said second pulley of said first block and tackle pulley system being disposed less than approximately one foot from said body harness, said body harness also being connected to said fourth pulley of said second block and tackle pulley system, said fourth pulley of said second block and tackle pulley system being disposed less than approximately one foot from said body harness.

2. The exercise machine of claim 1, wherein said open-ended upper portion of said support frame comprises:

a first arm member having a first end and a second end;

a second arm member having a first end and a second end; and a joining member, wherein said first end of said first arm is connected to said joining member and wherein said first end of said second arm member is connected to said joining member, said first arm member being substantially parallel to said second arm member, said first and second arm members extending in a substantially horizontal direction from said joining member, said first end of said open-ended upper portion being said second end of said first arm member, said second end of said open-ended upper portion being said second end of said second arm member.

3. The exercise machine of claim 1, wherein said body harness is removably connected to said second pulley of said first block and tackle pulley system by a first carabiner, and wherein said body harness is removably connected to said fourth pulley of said second block and tackle system by a second carabiner.

4. The exercise machine of claim 1, wherein said first pulley of said first block and tackle pulley system is connected to said first arm member of said open-ended upper portion at a first location, and wherein said third pulley of said second block and tackle pulley system is connected to said second arm member of said open-ended upper portion at a second location, said first and second locations being separated from one another by a separation within the range of approximately 16 to 28 inches.

5. The exercise machine of claim 1, wherein said support frame has a maximum height of less than approximately eight feet.

6. The exercise machine of claim 5, wherein said support frame has a maximum height of at least approximately six feet.

7. The exercise machine of claim 1, wherein said first handle comprises a first gymnastics hand ring, and wherein said second handle comprises a second gymnastics hand ring.

8. The exercise machine of claim 1, wherein said exercise machine is freestanding on said base portion of said support frame.

9. The exercise machine of claim 1, wherein said vertical support portion consists essentially of a single elongated member disposed in a substantially vertical dimension.

10. The exercise machine of claim 1, wherein said second pulley of said first block and tackle pulley system can extend a maximum distance of approximately four feet from said first pulley of said first block and tackle pulley system, and wherein fourth pulley of said second block and tackle pulley system can extend a maximum distance of approximately four feet from said third pulley of said second block and tackle pulley system.

11. The exercise machine of claim 1, further comprising a footrest usable to support the feet of a user when the user is suspended from said support frame and is using said first and second block and tackle pulley systems, said footrest being affixed to said vertical support portion of said support frame.

12. The exercise machine of claim 11, wherein said footrest is adjustable along a vertical dimension.

13. The exercise machine of claim 12, wherein said vertical support portion has a plurality of holes, said footrest removably engaging a selected one of said plurality of holes.

14. The exercise machine of claim 12, wherein said footrest is padded.

15. The exercise machine of claim 1, further comprising means for supporting a human body in a sit-up position, said means for supporting a human body in a sit-up position contacting said vertical support portion and having a padded upper surface.

16. The exercise machine of claim 15, wherein said padded upper surface of said means for supporting a human body in a sit-up position has a slope which is adjustable.

17. The exercise machine of claim 1, further comprising a pull-up bar.

18. The exercise machine of claim 1, further comprising a pair of substantially horizontally oriented parallel bars.

19. The exercise machine of claim 1, wherein said base portion rests on a surface, said support frame not being secured to the surface.

20. An exercise machine comprising:

means for suspending a human body above a surface such that no portion of said means for suspending is disposed directly above the head of the human body when the body is suspended in a vertical position from said means for suspending, said means for suspending being adapted for attachment to a wall;

means for utilizing a mechanical advantage so that musculature of the human body can lift the human body from said surface and can lift the human body toward said means for suspending, said means for utilizing a mechanical advantage being suspended from said means for suspending, said means for utilizing a mechanical advantage having a first handle graspable by a first hand of the human body, said means for utilizing a mechanical advantage having a second handle graspable by a second hand of the human body; and a body harness attaching said means for utilizing a mechanical advantage to the human body.

21. An exercise machine, comprising:

a support frame comprising a vertical support portion and an upper portion;

a first block and tackle pulley system hanging from said upper portion of said support frame, said first block and tackle pulley system comprising a first pulley, a second pulley, a flexible line operatively disposed with respect to said first and second pulleys, and a first handle connected to an end of said flexible line;

a second block and tackle pulley system hanging from said upper portion of said support frame, said second block and tackle pulley system comprising a third pulley, a fourth pulley, a flexible line operatively disposed with respect to said third and fourth pulleys, and a second handle connected to an end of said flexible line;

a body harness disengageably connectable to said first and second block and tackle pulley systems; and a padded footrest connectable directly to said vertical support portion of said support frame.

22. The exercise machine of claim 21, wherein said vertical support portion consists essentially of a single elongated member disposed in a substantially vertical dimension.

23. An exercise machine, comprising:

a support frame comprising a vertical support portion and an upper portion;

a first block and tackle pulley system hanging from said upper portion of said support frame, said first block and tackle pulley system comprising a first pulley connected to said upper portion at a first location, a second pulley, a flexible line operatively disposed with respect to said first and second pulleys, and a first handle connected to an end of said flexible line;

a second block and tackle pulley system hanging from said upper portion of said support frame, said second block and tackle pulley system comprising a third pulley connected to said upper portion at a second location, a fourth pulley, a flexible line operatively disposed with respect to said third and fourth pulleys, and a second handle connected to an end of said flexible line; and a body harness connected to said first and second block and tackle pulley systems, a first vertical plane extending in a vertical direction and intersecting both said first and second locations, no portion of said vertical support portion intersecting said first vertical plane, a second vertical plane extending in said vertical direction and intersecting said first location to be perpendicular to said first vertical plane, a third vertical plane extending in said vertical direction and intersecting said second location to be perpendicular to said first vertical plane, said upper portion being disposed substantially entirely between said second and third vertical planes.

24. The exercise machine of claim 23, wherein said vertical support portion is disposed substantially entirely between said second and third vertical planes, said first block and tackle pulley system having no more than two pulleys, said second block and tackle pulley system having no more than two pulleys.

* * * * *